US012529194B2

(12) United States Patent
Ligman

(10) Patent No.: US 12,529,194 B2
(45) **Date of Patent: *Jan. 20, 2026**

(54) SWING BOOM CONCRETE SCREEDING APPARATUS

(71) Applicant: Ligchine International Corporation, Floyds Knobs, IN (US)

(72) Inventor: Peter A. Ligman, Darien, WI (US)

(73) Assignee: Ligchine International Corporation, Floyds Knobs, IN (US)

( * ) Notice: Subject to any disclaimer, the term of this patent is extended or adjusted under 35 U.S.C. 154(b) by 917 days.

This patent is subject to a terminal disclaimer.

(21) Appl. No.: 17/678,706

(22) Filed: Feb. 23, 2022

(65) Prior Publication Data

US 2022/0267967 A1 Aug. 25, 2022

Related U.S. Application Data

(60) Provisional application No. 63/152,728, filed on Feb. 23, 2021.

(51) Int. Cl.
*E01C 19/42* (2006.01)

(52) U.S. Cl.
CPC ..... *E01C 19/42* (2013.01)

(58) Field of Classification Search
CPC ..... E01C 19/42
USPC ..... 404/118, 120
See application file for complete search history.

(56) References Cited

U.S. PATENT DOCUMENTS

| | | | |
|---|---|---|---|
| 1,284,385 | A | 11/1918 | Victor |
| 1,731,231 | A | 10/1929 | Chenoweth |
| 2,116,816 | A | 5/1938 | Winkler |
| 2,403,812 | A | 7/1946 | Claude |
| 2,636,290 | A | 4/1953 | Frank |
| 3,151,732 | A | 10/1964 | Foster |
| 3,341,029 | A | 9/1967 | Barkley |
| 3,377,933 | A | 4/1968 | Charles |
| 3,675,721 | A | 7/1972 | Davidson |
| 3,721,054 | A | 3/1973 | Hornagold |
| 3,749,504 | A | 7/1973 | Smith |
| 3,840,125 | A | 10/1974 | Cozad |
| 3,860,175 | A | 1/1975 | Westerlund et al. |
| 3,870,427 | A | 3/1975 | Allen |

(Continued)

FOREIGN PATENT DOCUMENTS

| | | |
|---|---|---|
| AU | 2019359107 | 5/2021 |
| AU | 2019357862 | 6/2021 |

(Continued)

OTHER PUBLICATIONS

European Patent Office: Intention to Grant issued in EP Application No. 19780088.1 mailed Dec. 4, 2023.

(Continued)

*Primary Examiner* — Raymond W Addie
(74) *Attorney, Agent, or Firm* — Dinsmore & Shohl LLP

(57) ABSTRACT

An apparatus for screeding concrete to produce a level finished surface includes a frame assembly having a front end and rear ends and a pair of spaced vertically oriented stabilization legs supporting a generally horizontal front member. An extendable boom assembly is provided having front and rear ends, and an exterior boom section pivotably secured to the frame assembly proximate said rear end. The extendable boom assembly is also adjustably mounted on said front member to allow generally lateral motion of the boom.

19 Claims, 20 Drawing Sheets

(56) References Cited

U.S. PATENT DOCUMENTS 3,901,616 A 8/1975 Greening
3,953,052 A 4/1976 Palmcrantz
3,964,512 A 6/1976 Dumas
3,966,345 A 6/1976 Kofel
3,969,035 A 7/1976 Silbernagel
3,970,405 A 7/1976 Swisher, Jr.
4,029,165 A 6/1977 Miller
4,036,372 A 7/1977 Rao
4,084,777 A 4/1978 Lambert
4,192,626 A 3/1980 Silver
4,231,678 A 11/1980 Carternock
4,363,409 A 12/1982 Laurich-Trost
4,406,375 A 9/1983 Hockensmith
4,422,795 A 12/1983 Berrange
4,502,505 A 3/1985 Moller
4,566,823 A 1/1986 May
4,655,633 A 4/1987 Somero
4,700,786 A 10/1987 Berry
4,770,304 A 9/1988 Woods
4,789,266 A 12/1988 Clarke, Jr.
4,869,618 A 9/1989 Morrison
4,896,995 A 1/1990 Simmons
4,930,935 A 6/1990 Quenzi
4,936,763 A 6/1990 Thomas
4,978,246 A 12/1990 Quenzi
4,988,233 A 1/1991 Kasler
5,009,546 A 4/1991 Domenighetti
5,018,555 A 5/1991 Hawerkamp
5,039,249 A 8/1991 Hansen
5,045,025 A 9/1991 Underwood
5,051,025 A 9/1991 Taylor, Jr.
5,120,186 A 6/1992 Jorgenson
5,129,803 A 7/1992 Nomura
5,192,102 A 3/1993 Mertens
5,217,320 A 6/1993 Cioffi
5,224,793 A 7/1993 De Pol
5,234,128 A 8/1993 Hill
5,234,281 A 8/1993 Somero
5,244,305 A 9/1993 Lindley
5,348,418 A 9/1994 Campbell
5,351,716 A 10/1994 Korthaus
5,360,097 A 11/1994 Hibbs
5,375,942 A 12/1994 Lindley
5,515,654 A 5/1996 Anderson
5,533,831 A 7/1996 Allen
5,556,226 A 9/1996 Hohmann, Jr.
5,558,118 A 9/1996 Mooring
5,567,075 A 10/1996 Allen
5,868,156 A 2/1999 Korthaus
6,129,481 A 10/2000 Tapio
6,155,708 A 12/2000 Lindley
6,203,244 B1 3/2001 Van Ornum
6,227,761 B1 5/2001 Kieranen
6,325,531 B1 12/2001 Lindley
6,328,115 B1 12/2001 Carter, Jr.
6,447,204 B1 9/2002 McDonald
6,481,924 B1 11/2002 Smolders
6,485,227 B1 11/2002 Mathiowetz
6,508,606 B1 1/2003 James, III
6,530,721 B2 3/2003 Yost
6,588,448 B1 7/2003 Raymond
6,654,532 B1 11/2003 Satoru
6,662,939 B1 12/2003 McCusker
6,695,532 B2 2/2004 Somero
6,729,796 B1 5/2004 Green
6,814,532 B1 11/2004 Thompson
6,843,615 B1 1/2005 Cook
6,857,816 B2 2/2005 Saito
6,860,676 B2 3/2005 Pont Feixes
6,976,454 B2 12/2005 Cattaruzzi
7,004,675 B2 2/2006 Wayne
7,044,681 B2 5/2006 Quenzi
7,121,762 B2 10/2006 Quenzi
7,144,191 B2 12/2006 Kieranen
7,172,363 B2 2/2007 Olson
7,175,363 B2 2/2007 Quenzi
7,195,423 B2 3/2007 Halonen
7,195,424 B2 3/2007 Lindley
7,223,059 B2 5/2007 Smith
7,232,277 B2 6/2007 Corbitt
7,296,676 B2 11/2007 Smith
7,311,466 B2 12/2007 Torvinen
7,320,558 B2 1/2008 Quenzi
7,328,810 B1 2/2008 Rhodes
7,396,186 B2 7/2008 Quenzi
7,399,139 B2 7/2008 Kieranen
7,407,339 B2 8/2008 Halonen
7,497,140 B2 3/2009 Blackwelder
7,500,814 B2 3/2009 Meyer
7,540,685 B2 6/2009 Avikainen
7,540,686 B2 6/2009 Heims
7,540,687 B2 6/2009 Neumann
7,559,719 B2 7/2009 Nasby
7,621,694 B1 11/2009 Goodman
7,685,929 B2 3/2010 Mainville
7,748,789 B2 7/2010 Freeburn
7,775,742 B2 8/2010 Buijsman
7,850,396 B2 12/2010 Pietila
7,854,565 B2 12/2010 Halonen
7,874,571 B2 1/2011 Frey
7,891,479 B2 2/2011 Evangelista
7,909,533 B2 3/2011 Quenzi
8,128,390 B2 3/2012 O'Hara
8,132,659 B2 3/2012 Coers
8,152,409 B1 4/2012 Ligman
8,220,806 B2 7/2012 Neudeck
8,312,957 B1 11/2012 Stolzfus
8,322,947 B2 12/2012 Neumann
8,403,594 B2 3/2013 Neumann
8,408,377 B2 4/2013 Werlinger
8,464,859 B2 6/2013 Campbell
8,506,232 B2 8/2013 Gallione
8,591,142 B2 11/2013 Mittleman
8,657,215 B1 2/2014 Blum
8,794,868 B2 8/2014 Fritz
8,919,526 B2 12/2014 Fickeisen
8,944,445 B2 2/2015 Cook et al.
8,985,301 B2 3/2015 Werlinger
9,180,909 B1 11/2015 Coats
9,199,828 B2 12/2015 Steinich
9,290,337 B2 3/2016 Sheehan
9,297,171 B1 3/2016 Ligman
9,316,343 B2 4/2016 O'Hara
9,376,260 B2 6/2016 Saarinen
9,404,272 B1 8/2016 Ligman
9,428,869 B2 8/2016 Pedersen
9,463,933 B2 10/2016 Diebold
9,493,914 B2 11/2016 Kaiser
9,516,400 B1 12/2016 Roberts et al.
9,637,318 B2 5/2017 Messina
9,695,604 B2 7/2017 Trumper
9,701,481 B2 7/2017 Wilcox
9,708,779 B2 7/2017 Brown
9,708,780 B1 7/2017 Ligman
9,783,093 B1 10/2017 Esch
9,809,937 B2 11/2017 Berning
9,828,184 B1 11/2017 Bynum
9,850,671 B2 12/2017 Mapelli et al.
9,873,993 B2 1/2018 Berning
9,909,267 B1 3/2018 Ligman
9,969,558 B1 5/2018 Bynum
RE46,971 E 7/2018 Neumann
10,017,097 B2 7/2018 Ozinga
10,035,446 B2 7/2018 Szentimrey
10,112,775 B2 10/2018 Hanel
10,150,660 B2 12/2018 Koppelaar
10,190,270 B2 1/2019 Hirman
10,233,658 B1 3/2019 Ligman
10,337,153 B2 7/2019 Hoffmann
10,370,801 B2 8/2019 Pinson
10,443,251 B2 10/2019 Eenigenburg et al.
10,464,758 B2 11/2019 Wilcox
10,494,776 B2 12/2019 Pietila
10,526,754 B2 1/2020 Fox

(56) References Cited

U.S. PATENT DOCUMENTS

| | | | |
|---|---|---|---|
| 10,625,990 | B2 | 4/2020 | Henikl et al. |
| 10,688,902 | B2 | 6/2020 | Rexius |
| 10,710,093 | B2 | 7/2020 | Mcdevitt |
| 10,717,601 | B2 | 7/2020 | Kornelsen |
| 10,760,226 | B2 | 9/2020 | Guntert, Jr. |
| 10,766,710 | B2 | 9/2020 | Bacon-Maldonado, III |
| 10,794,016 | B2 | 10/2020 | Mckinnon |
| 10,913,381 | B2 | 2/2021 | Bacon-Maldonado, III |
| 10,914,051 | B2 | 2/2021 | Keigley |
| 10,961,728 | B2 | 3/2021 | Eenigenburg et al. |
| 11,098,491 | B2 | 8/2021 | Henikl et al. |
| 11,162,232 | B2 | 11/2021 | Ligman |
| 11,187,001 | B1 | 11/2021 | Bynum |
| 11,753,253 | B1 | 9/2023 | Bynum |
| 12,270,159 | B2 | 4/2025 | Ligman |
| 2002/0015618 | A1 | 2/2002 | Quenzi |
| 2002/0125100 | A1 | 9/2002 | Dennis |
| 2002/0127058 | A1 | 9/2002 | Zachman |
| 2003/0161684 | A1 | 8/2003 | Quenzi |
| 2004/0009038 | A1 | 1/2004 | Roth |
| 2004/0076472 | A1 | 4/2004 | Holmes |
| 2004/0154237 | A1 | 8/2004 | Mainville |
| 2005/0141963 | A1 | 6/2005 | Holmes |
| 2005/0207843 | A1 | 9/2005 | Jackson |
| 2005/0263302 | A1 | 12/2005 | Newnam |
| 2006/0018715 | A1 | 1/2006 | Halonen |
| 2006/0120801 | A1 | 6/2006 | Johnson |
| 2006/0216114 | A1 | 9/2006 | Quenzi |
| 2007/0031191 | A1 | 2/2007 | Quenzi |
| 2007/0116520 | A1 | 5/2007 | Quenzi |
| 2007/0127985 | A1 | 6/2007 | Halonen |
| 2007/0140792 | A1 | 6/2007 | Quenzi |
| 2007/0154260 | A1 | 7/2007 | Lindley |
| 2008/0135375 | A1 | 6/2008 | Pettijohn |
| 2008/0253221 | A1 | 10/2008 | Lindley |
| 2010/0008750 | A1 | 1/2010 | Jones |
| 2010/0183369 | A1 | 7/2010 | Lindley |
| 2010/0215433 | A1 | 8/2010 | Fritz |
| 2010/0266339 | A1 | 10/2010 | Guntert, Jr. |
| 2010/0296868 | A1 | 11/2010 | Braun |
| 2011/0002736 | A1 | 1/2011 | Monger |
| 2011/0126700 | A1 | 6/2011 | Johannsen |
| 2011/0236129 | A1 | 9/2011 | Guntert, Jr. |
| 2011/0266774 | A1 | 11/2011 | Gregg |
| 2012/0183350 | A1 | 7/2012 | Mittleman |
| 2013/0294834 | A1 | 11/2013 | Pai |
| 2013/0333253 | A1 | 12/2013 | Philippe |
| 2014/0125023 | A1 | 5/2014 | Cook et al. |
| 2014/0169881 | A1 | 6/2014 | Hagen |
| 2014/0331632 | A1 | 11/2014 | Schots |
| 2014/0363232 | A1 | 12/2014 | Pietila |
| 2015/0093193 | A1 | 4/2015 | Zimmermann |
| 2015/0258926 | A1 | 9/2015 | Wick |
| 2015/0367388 | A1 | 12/2015 | Wang |
| 2016/0009507 | A1 | 1/2016 | Wiseman |
| 2016/0145880 | A1 | 5/2016 | Mapelli et al. |
| 2016/0177519 | A1 | 6/2016 | Fritz |
| 2016/0245917 | A1 | 8/2016 | Schoonmaker |
| 2017/0218576 | A1 | 8/2017 | Lindley |
| 2017/0218577 | A1 | 8/2017 | Lindley |
| 2018/0106056 | A1 | 4/2018 | Eenigenburg et al. |
| 2018/0162701 | A1 | 6/2018 | Heniki et al. |
| 2018/0327982 | A1 | 11/2018 | Leukuma |
| 2018/0334332 | A1 | 11/2018 | Eberts |
| 2020/0010006 | A1 | 1/2020 | Wilson |
| 2020/0056386 | A1 | 2/2020 | Eenigenburg et al. |
| 2020/0109525 | A1 | 4/2020 | Ligman |
| 2020/0109526 | A1 | 4/2020 | Ligman |
| 2020/0109573 | A1 | 4/2020 | Ligman |
| 2020/0248413 | A1 | 8/2020 | Wolf |
| 2020/0263367 | A1 | 8/2020 | Berning |
| 2020/0290494 | A1 | 9/2020 | Key |
| 2020/0346254 | A1 | 11/2020 | Opatril |
| 2020/0392675 | A1 | 12/2020 | Guntert, Jr. |
| 2020/0392747 | A1 | 12/2020 | Heniki et al. |
| 2020/0399071 | A1 | 12/2020 | Wilson |
| 2021/0053766 | A1 | 2/2021 | Bacon-Maldonado, III |
| 2021/0131046 | A1 | 5/2021 | Hirman |
| 2021/0139246 | A1 | 5/2021 | Wilson |
| 2022/0049436 | A1 | 2/2022 | Ligman |
| 2022/0162814 | A1 | 5/2022 | Ligman |
| 2022/0196000 | A1 | 6/2022 | Butler |
| 2022/0267967 | A1 | 8/2022 | Ligman |
| 2023/0279680 | A1 | 9/2023 | Ligman |
| 2023/0295884 | A1 | 9/2023 | Ligman |
| 2024/0240413 | A1 | 7/2024 | Ligman |

FOREIGN PATENT DOCUMENTS

| | | | |
|---|---|---|---|
| AU | 2019358780 | | 6/2021 |
| CA | 2272485 | | 11/2000 |
| CN | 208885016 | | 5/2019 |
| CN | 111058636 | | 4/2020 |
| CN | 108086688 | | 6/2020 |
| CN | 113525557 | | 10/2021 |
| DE | 102006031257 | | 1/2008 |
| DE | 102013218383 | | 3/2015 |
| EP | 1256657 | A1 | 11/2002 |
| EP | 1267000 | A2 | 12/2002 |
| EP | 0838563 | | 10/2003 |
| EP | 3864236 | | 8/2021 |
| EP | 3864237 | | 8/2021 |
| EP | 3864238 | | 8/2021 |
| EP | 4430255 | | 9/2024 |
| ES | 2247952 | A1 | 3/2006 |
| GB | 2246997 | | 2/1992 |
| KR | 19980049557 | | 10/1998 |
| WO | WO 2006133490 | | 12/2006 |
| WO | WO 2018069514 | | 4/2018 |
| WO | 2019133917 | A1 | 7/2019 |
| WO | 2020009821 | A1 | 1/2020 |
| WO | 2020076468 | A1 | 4/2020 |
| WO | 2020076469 | A1 | 4/2020 |
| WO | 2020076470 | A1 | 4/2020 |
| WO | 2020148632 | A1 | 7/2020 |
| WO | 2020150808 | A1 | 7/2020 |
| WO | 2022182755 | A1 | 9/2022 |
| WO | 2023278421 | | 1/2023 |
| WO | WO2023076906 | A1 | 5/2023 |
| WO | WO 2023086881 | | 5/2023 |
| WO | WO 2024155626 | | 7/2024 |

OTHER PUBLICATIONS

European Patent Office: Intention to Grant issued in EP Application No. 19779704.6 mailed Dec. 4, 2023.

European Patent Office: Intention to Grant issued in EP Application No. 19779340.9 mailed Dec. 11, 2023.

European Patent Office; International Search Report and Written Opinion for PCT App. No. PCT/US2019/051694 dated Nov. 7, 2019.

European Patent Office; International Search Report and Written Opinion for PCT App. No. PCT/US2019/051695 dated Nov. 7, 2019.

European Patent Office; International Search Report and Written Opinion for PCT App. No. PCT/US2019/051698 dated Nov. 7, 2019.

European Patent Office; International Search Report and Written Opinion for PCT App. No. PCT/US2022/017515 dated May 12, 2022.

European Patent Office; International Search Report and Written Opinion for PCT App. No. PCT/US2022/035287 mailed Oct. 21, 2022.

European Patent Office; International Search Report and Written Opinion for PCT App. No. PCT/US2022/078664 mailed Feb. 10, 2023.

U.S. Appl. No. 18/315,925, filed May 11, 2023 titled Electronically Actuated Leveling System for Screeding Concrete.

U.S. Appl. No. 18/322,962, filed May 24, 2023 titled Swing Boom Concrete Screeding Apparatus.

SWING BOOM CONCRETE SCREEDING APPARATUS

BACKGROUND OF THE INVENTION

Field of the Invention

The apparatus disclosed herein relates generally to a system and apparatus for leveling and finishing or "screeding" concrete and more specifically to a concrete screed apparatus for screeding a poured concrete surface that is capable of screeding around obstacles in the poured surface with minimal disruption in the screeding process. The concrete screed apparatus includes an adjustable and controllable screed head frame that is capable of generally lateral horizontal motion with respect to the poured surface, thereby providing the ability to move a screed head secured to the screed head frame around an obstacle without moving the entire apparatus to a new location.

Description of the Related Art

In the construction industry when liquid concrete is poured to produce a finished surface it must be quickly and carefully smoothed or screeded, so that when the concrete sets it produces an even, level surface. Since this level surface is almost always a foundation for additional construction, a machine base pad or foundation, or for mounting vertical storage such as warehousing and shelving space, it is highly desirable to produce a surface that is consistently level over its entire area. In large poured areas it is unwieldy and labor intensive to manually level and smooth a poured concrete surface as well as extremely difficult to maintain a consistent finished grade.

In order to aid in the screeding of large surface area concrete pours, a variety of concrete screed or troweling machines have been accepted into use in the art. These machines typically include a screed head comprising a flat troweling surface for contacting, leveling, and smoothing the poured concrete. The screed head in many devices is mounted on a boom that is mechanically extended and retracted across the concrete surface to produce a smooth surface finish. Many of these prior art devices include various systems for leveling the screed head relative to a reference plane such that the finished surface is relatively flat once it is screeded.

The leveling systems in prior art screed devices may encompass laser eyes mounted on the screed head structure that detect a laser beam projected at a predetermined level reference height above grade. Thus the screed head may be adjusted using a wide variety of adjustment mechanisms to a predetermined grade level by aligning said laser eyes with a projected laser beam. Furthermore, many of these devices provide automated systems for adjusting the screed head upwardly or downwardly to a level reference plane, thus obviating the need for manual alignment. In some systems, the automated adjustment of the screed head requires the use of multiple sensors and actuators along with the concomitant wiring and computerized control systems required to effect the necessary leveling adjustments.

Prior art screed devices often comprise a frame having a centrally mounted turret from which a boom is extended. Some systems comprise rigid frame structures from which a boom is extended. A screed head for smoothing the poured concrete is secured to the boom and leveled, using a wide variety of known leveling techniques, and is then retracted back across the poured concrete surface to achieve a smooth level finished surface. The leveling process for the screed head is typically a continuous process that maintains a level grade during the retraction of the boom.

However, one disadvantage to known concrete screed machines, often called "screeders", is their inability to be maneuvered around obstacles that may be located in the surface being finished. For example, almost all poured concrete surfaces have something extending upwardly through them. Support columns, conduits, heating and cooling ducts, plumbing chases, and decorative members are all examples of obstacles that may extend up through a poured concrete surface. Using prior art machines to finish these surfaces requires a great deal of hand finishing, since the screed head is difficult to move around the obstacle as it is being retracted.

Many prior art screed machines must be moved multiple times to make multiple passes around an obstacle, while a great deal of hand finishing is used near the obstacle to finish the poured area adjacent to it that cannot be reached by the screed machine. In fact, while many prior art screed devices are available, a great deal of concrete screeding is still accomplished by hand due to the size and lack of maneuverability of automated screed machines. Of course, hand finishing is slow and labor intensive, and thus adds expense to any concrete pour.

Accordingly, there is a need in the art for a system, method and apparatus for troweling concrete that provides a consistently level finished surface with the ability to maneuver the screed head used to contact and finish the surface laterally, as well as quickly and easily around obstacles that may be located in a concrete pour.

SUMMARY OF THE INVENTION

The apparatus disclosed herein provides a screed that includes a frame having an extendable and retractable boom mounted thereon, the boom having a screed head secured at its terminal end for contacting, leveling, and smoothing a poured concrete surface as the screed head is retracted across the poured concrete.

In some embodiments the boom is pivotally mounted to the frame near a rear end thereof, and adjustably mounted to an arcuate frame member mounted to the front portion of the frame. Accordingly, the boom can "swing" from side to side, thereby providing the ability to laterally move the boom and thus the screed head mounted thereto around obstacles or impediments in a concrete pour.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

Other features, objects and advantages of the various aspects and embodiments disclosed herein will become apparent from the detailed description of the drawing Figures taken in conjunction with the appended drawing Figures, wherein like reference characters generally refer to the same parts throughout the different view. The drawings are not necessarily to scale. Emphasis is instead generally placed upon illustrating the principles of the disclosure.

BRIEF DESCRIPTION OF THE DRAWING FIGURES

DETAILED DESCRIPTION OF THE PREFERRED EMBODIMENT(S)

Figure 1:
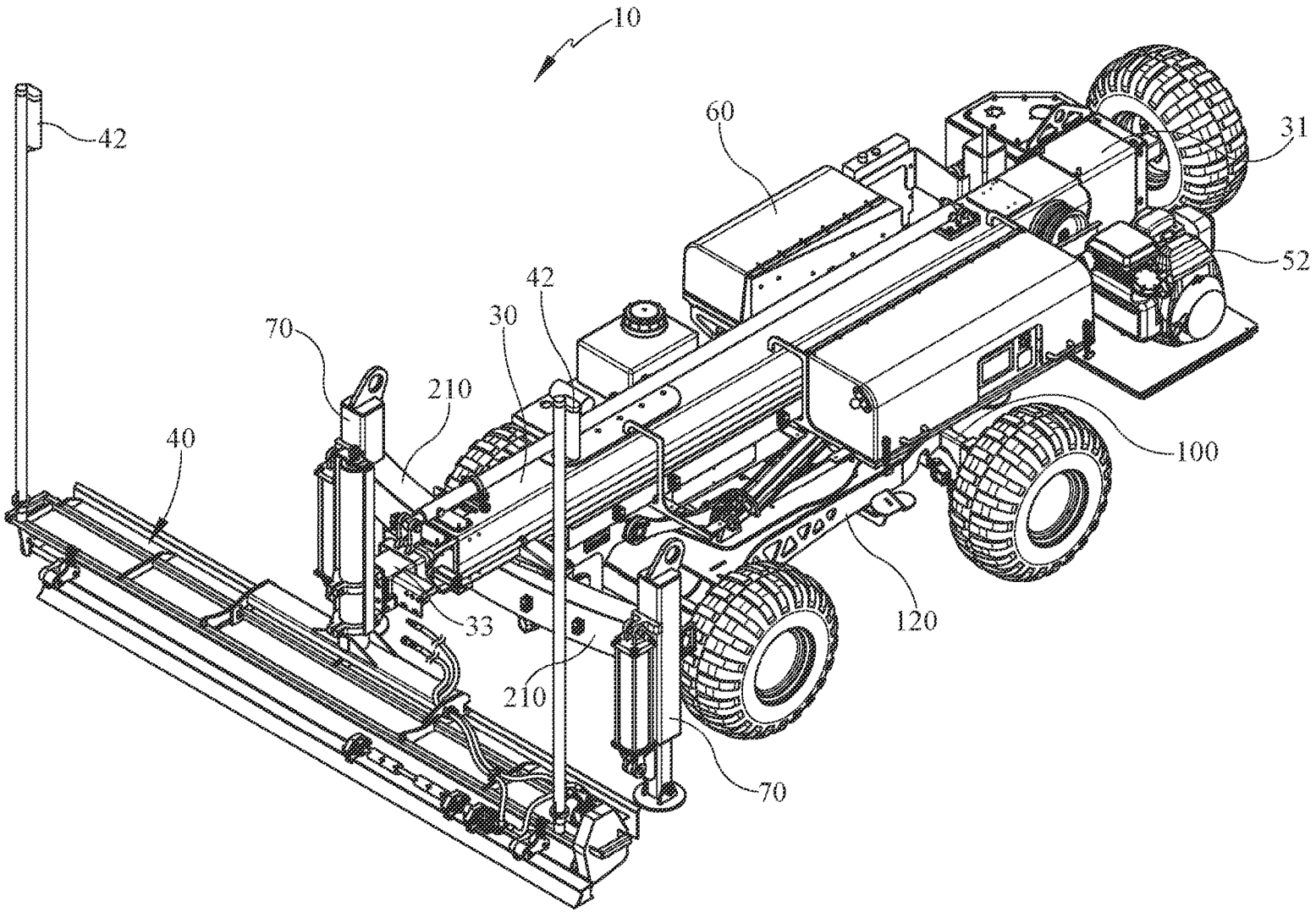
FIG. 1 is a perspective view of a concrete screeding apparatus in accordance with one embodiment.

Referring now to drawing FIGS. 1-8, and in accordance with some aspects and non-limiting embodiments, the apparatus overcomes the aforementioned difficulties in the prior art by providing a concrete screeding apparatus 10, known in the art as a screeder, having a telescopic boom assembly 30 and rigid frame assembly 50 that boom assembly 30 is adjustably secured thereto. One of ordinary skill in the art will recognize that a wide variety of frame assemblies 50 may be employed in the apparatus of the invention without departing from the scope thereof.

In some aspects of the invention, a conventional internal combustion engine 52 having an output shaft coupled to a hydraulic assembly 60 is provided, for supplying pressurized hydraulic fluid to a plurality of components necessary to operate screeder 10 via a plurality of electrically actuated control valves, as will be discussed in greater detail herein below.

The invention may further include a drive assembly 100 that is powered by pressurized hydraulic fluid, electric motors, or driven gear or chain systems as necessary to move screed apparatus 10. The drive 100 may be advantageously mounted on an undercarriage 120 such that it is rotatable with respect to frame 50, to allow screed apparatus 10 to be moved "sideways", or parallel to the direction of screeding for a concrete pour. This motion may also be described as lateral motion. Furthermore, drive assembly 100 and undercarriage 120 may in some aspects of the invention be rotatably mounted directly to rigid frame 50.

Figure 2:
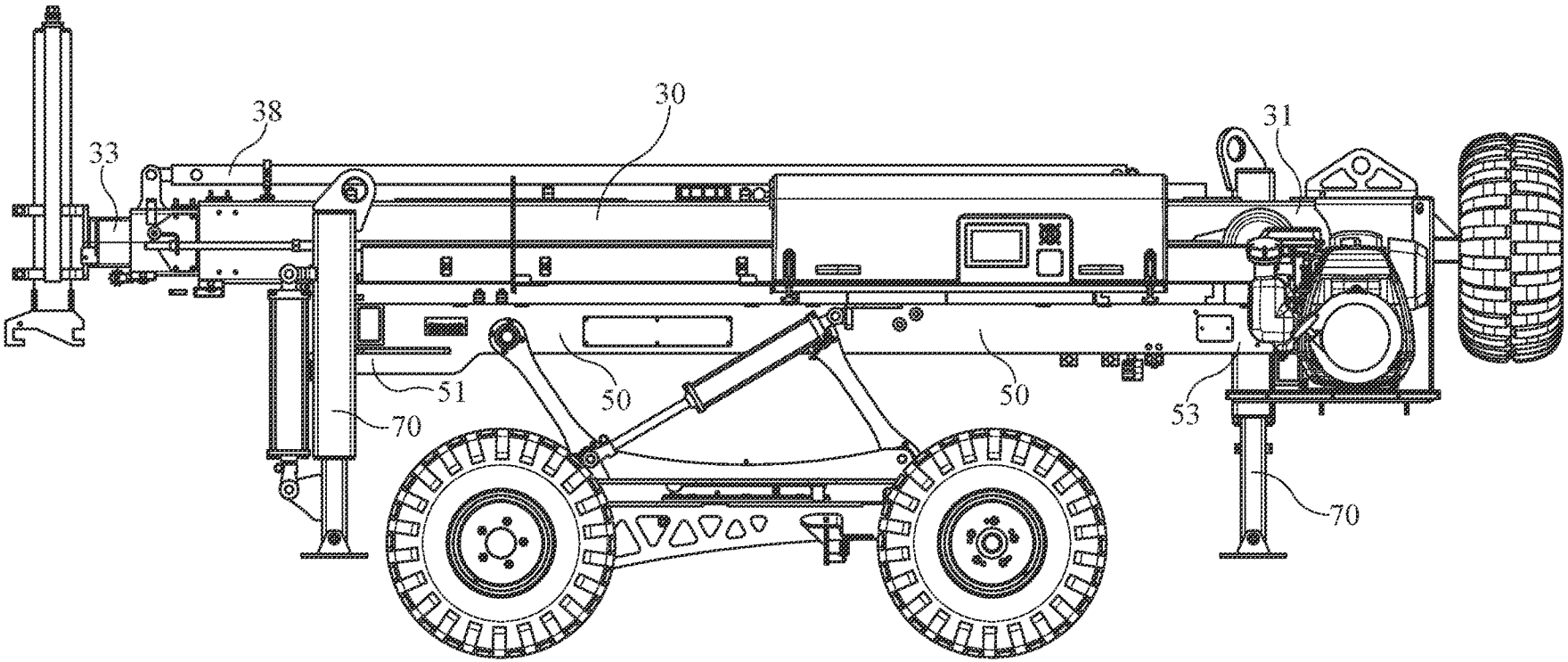
FIG. 2 is a side view of a concrete screeding apparatus in accordance with one embodiment.
Figure 9:
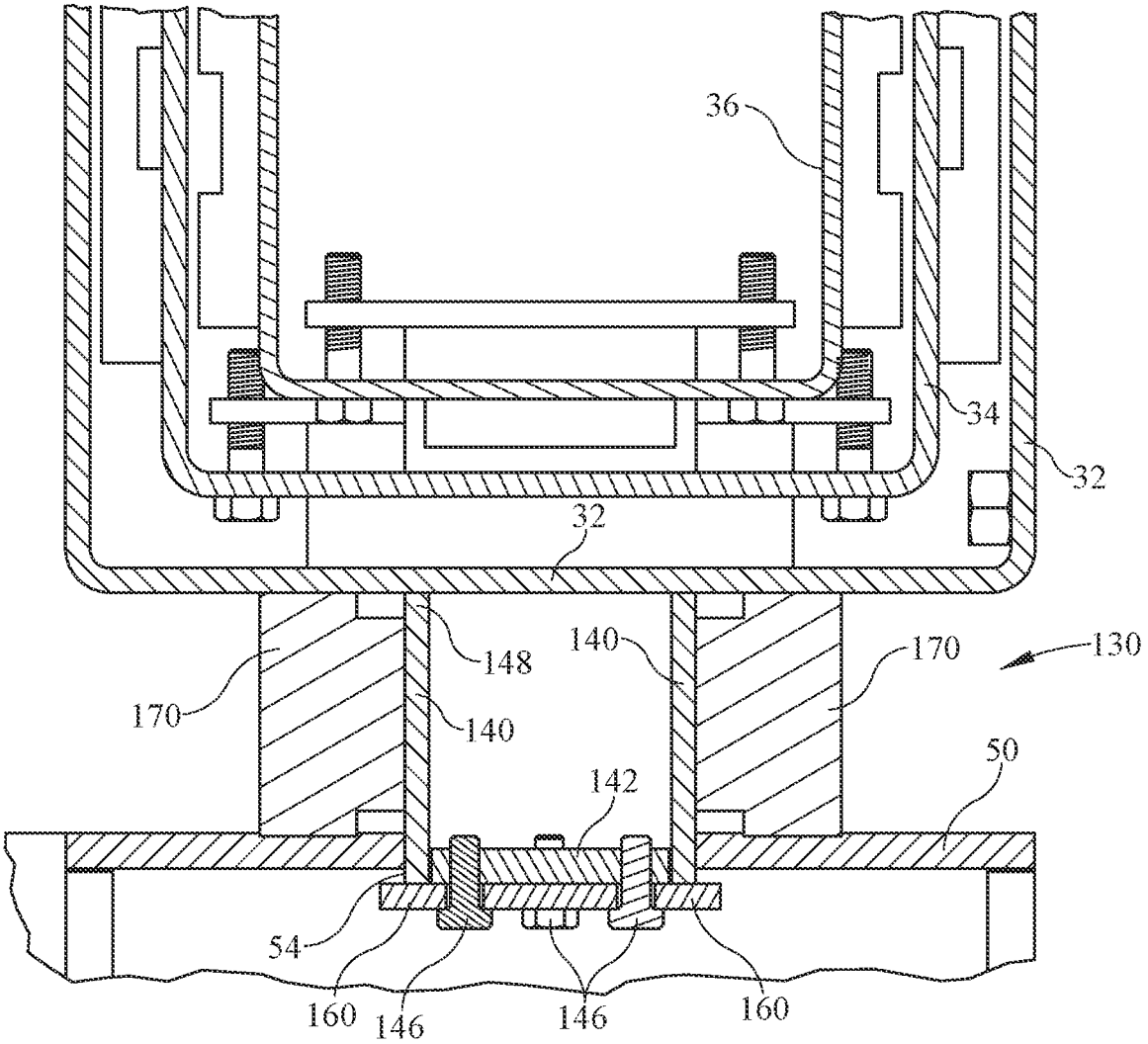
FIG. 9 is a partial cross-sectional view of a pivot assembly taken along the line 9-9 of FIG. 3.

Referring again to FIGS. 1-3 boom assembly 30 includes a rear end 31 and a forward end 33, and may in certain embodiments be secured to a screed head 40 at the forward end 33 that operates to smooth and level a poured concrete surface, the screed head 40 having a plurality of leveling eyes 42 secured or appended thereto that are used to level boom assembly 30 with respect to a reference plane, thereby providing a level finished concrete surface as screed head 40 is retracted toward screed apparatus 10. Boom assembly 30 has a rear end 31, and may include a plurality of nested extending boom sections 32, 34, 36, that may be extended and retracted in the general direction of screeding by an actuator 38, such as a hydraulic cylinder or linear actuator, as best depicted in FIGS. 2 and 9, for example. Boom section 32 is depicted as having the largest cross-sectional area and is therefore the exterior boom section 32. Thus sections 34, 36 may be retracted into an interior portion of boom 32 and then extend therefrom during operation of apparatus 10. In various aspects and embodiments leveling eyes 42 may comprise laser transmitters that emit light that is received by a receiver (not shown), thereby providing the ability to adjust screed head 40 to a reference plane, as is known in the art.

In accordance with some embodiments, and as depicted in FIGS. 1-8, concrete screed apparatus 10 may include or incorporate a rigid frame assembly 50 on which a conventional internal combustion engine 52 is mounted. Engine 52 supplies power via a conventional output shaft to a hydraulic assembly 60, also mounted on frame assembly 50. Hydraulic assembly 60 may typically include a pump 62 for pressurizing hydraulic fluid and a plurality of electrically actuated control valves (not shown) for routing and supplying pressurized hydraulic fluid to a plurality of components as discussed in detail below.

In various non-limiting embodiments hydraulic assembly 60 may further comprise a control system (not shown) which may include a microprocessor, data memory, inputs and outputs, a wireless transceiver 64, and requisite wiring to electrically connect the control system to the plurality of valves. Furthermore, throughout the specification the operation of hydraulic cylinders will be understood to be effected through the use of a conventional hydraulic system 60, comprising electrically actuated hydraulic valves and a control system for operating said valves, as is known to one of ordinary skill in the art. Furthermore, an operator interface, whether wireless or integral to apparatus 10, may be operatively coupled to apparatus 10 to control the various actuators and components described. An operator interface may comprise switches, joysticks, touchscreens, keypads, keyboards, or any other user-operated control without departing from the scope of the disclosed embodiments.

In further aspects and embodiments a plurality of adjustable stabilization legs 70 are secured in a generally vertical orientation to frame assembly 50 at a plurality of points around the perimeter thereof. As shown in the drawing Figures, in one exemplary embodiment two opposed legs 70 are secured to frame assembly 50 at a forward end 51 thereof, as described in more detail below, while a single leg 70 is secured to a rear end 53 of frame assembly 50. One of ordinary skill in the art will understand that the number and positioning of legs 70 around frame assembly 50 may be varied without departing from the scope of the embodiments. Each leg 70 is further secured to a hydraulic cylinder 66 which is also secured to frame 50 at a point, and that is utilized to level boom assembly 30 with respect to a reference plane, thereby leveling entire screeding apparatus 10 as well as screed head 40. This feature provides an extremely level finished concrete surface, since boom 30 and screed head 40, once leveled, are unable to move with respect to a desired reference plane.

Referring to FIGS. 3-11, a swing boom system 200 is shown that enables boom assembly 30 to pivot around a central axis located at rear end 31 of boom assembly 30, and thus further permits front end 33 of boom assembly 30 to describe an arcuate path, as will be described in detail herein below.

Figure 10:
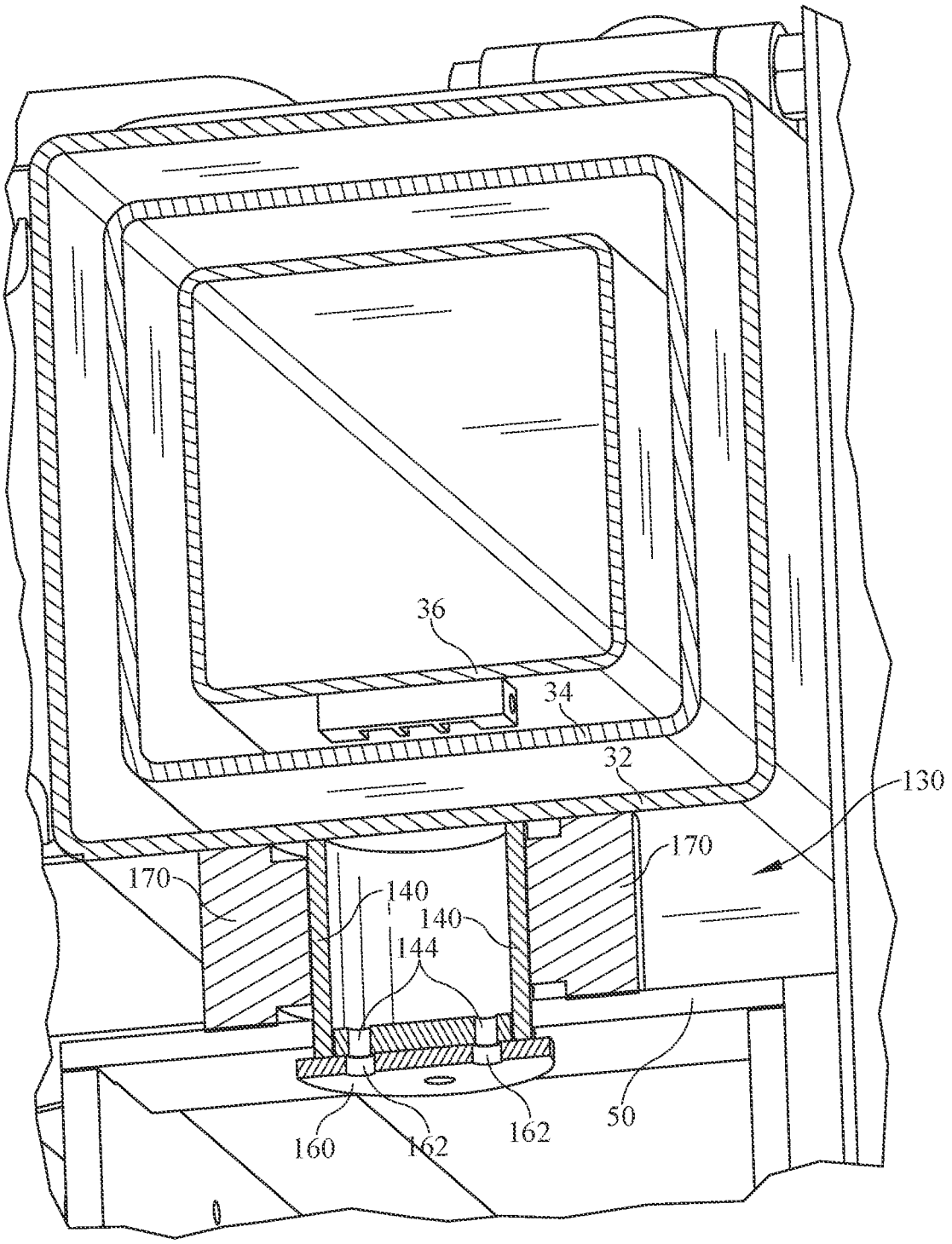
FIG. 10 is a partial cross-sectional perspective view of a pivot assembly similar to that of FIG. 9.
Figure 11:
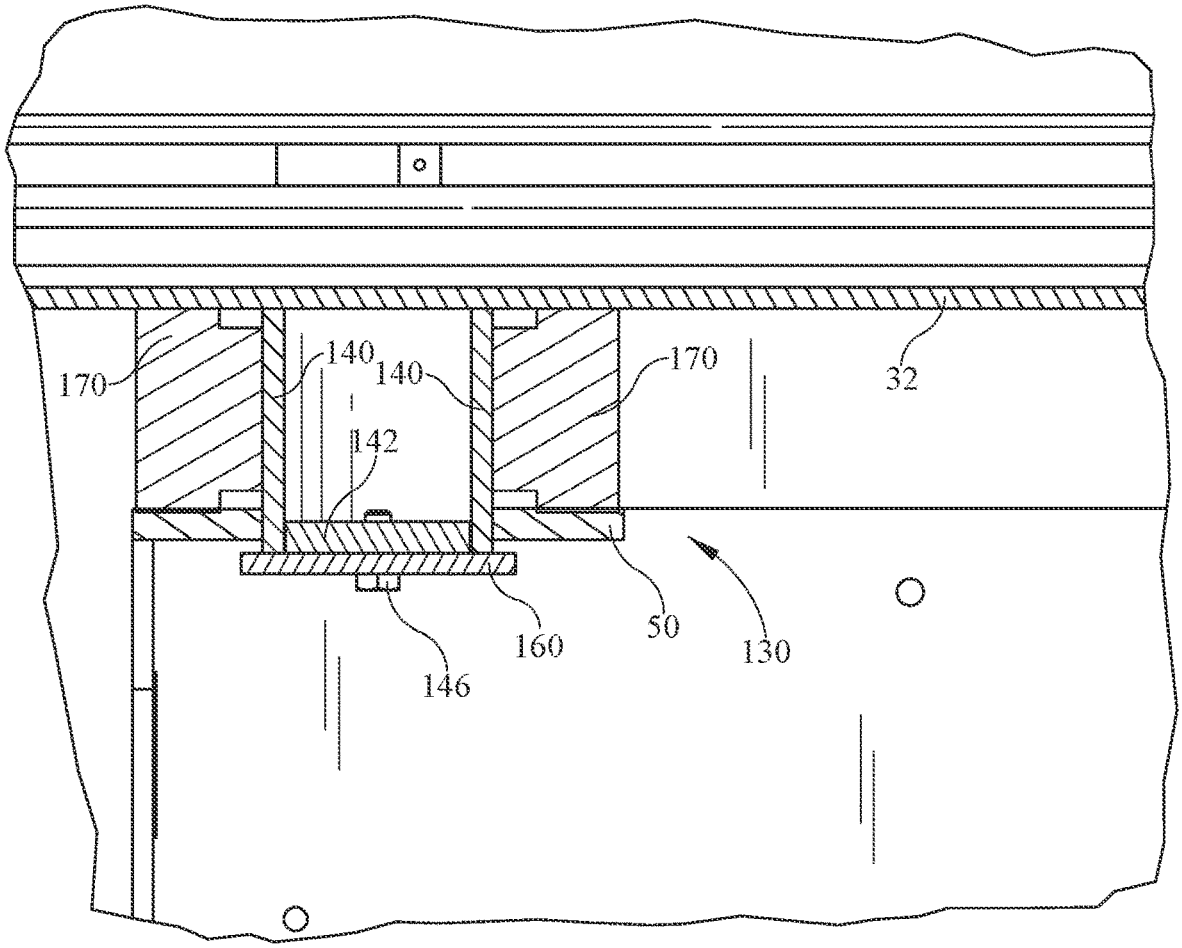
FIG. 11 is a partial cross-sectional view of a pivot assembly taken along the line 11-11 of FIG. 4.
Figure 12:
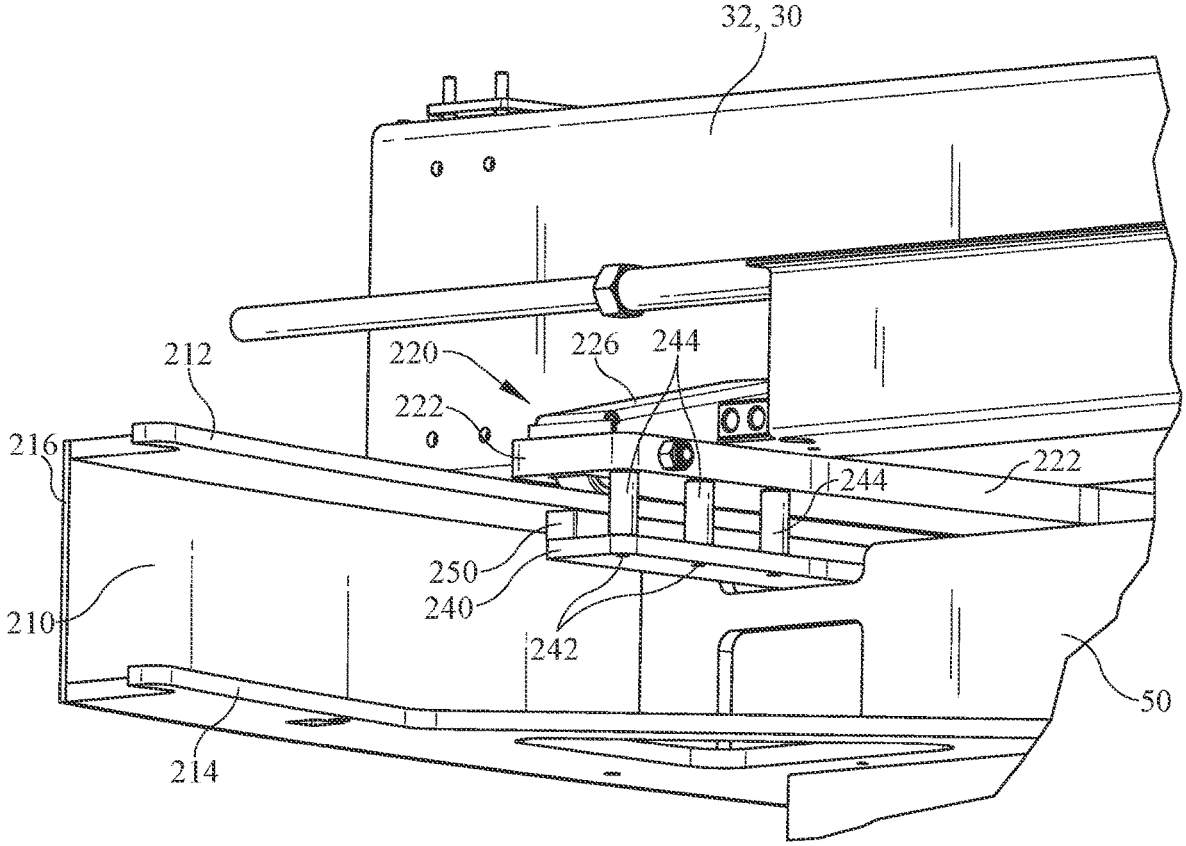
FIG. 12 is a partial perspective view of a swing boom assembly.
Figure 13:
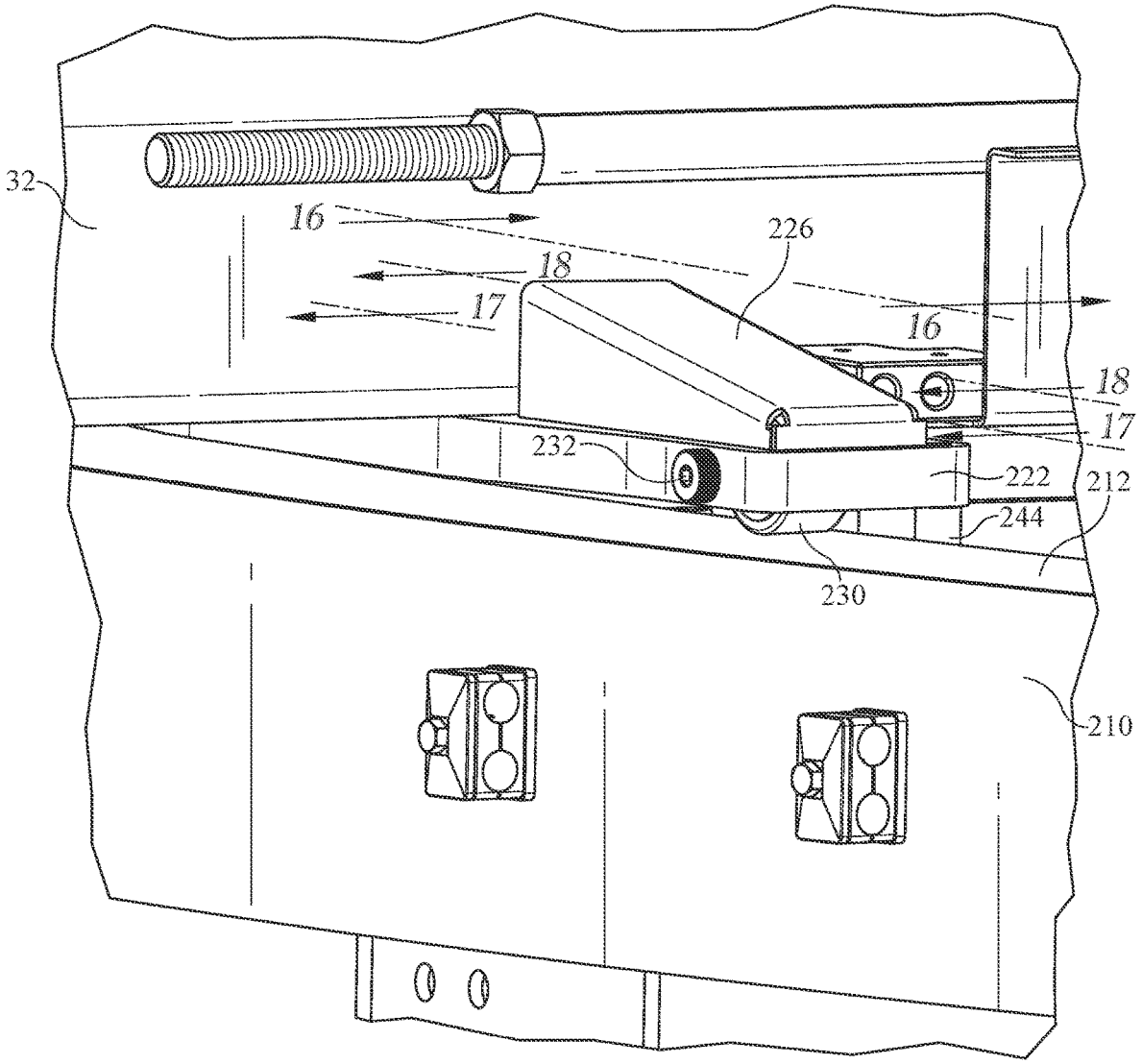
FIG. 13 is a partial perspective view of a swing boom assembly.
Figure 14:
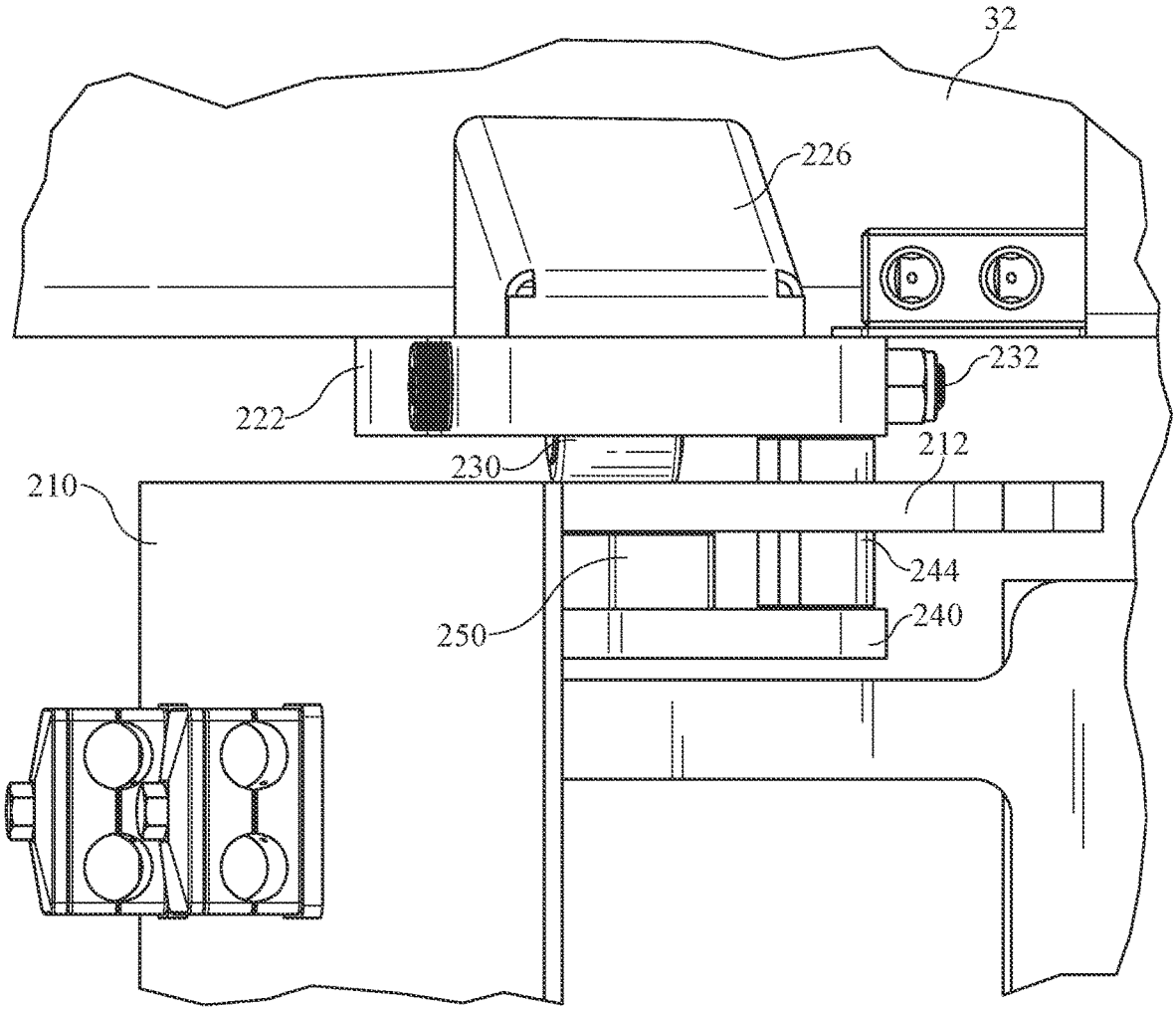
FIG. 14 is a partial perspective view of a swing boom assembly.
Figure 15:
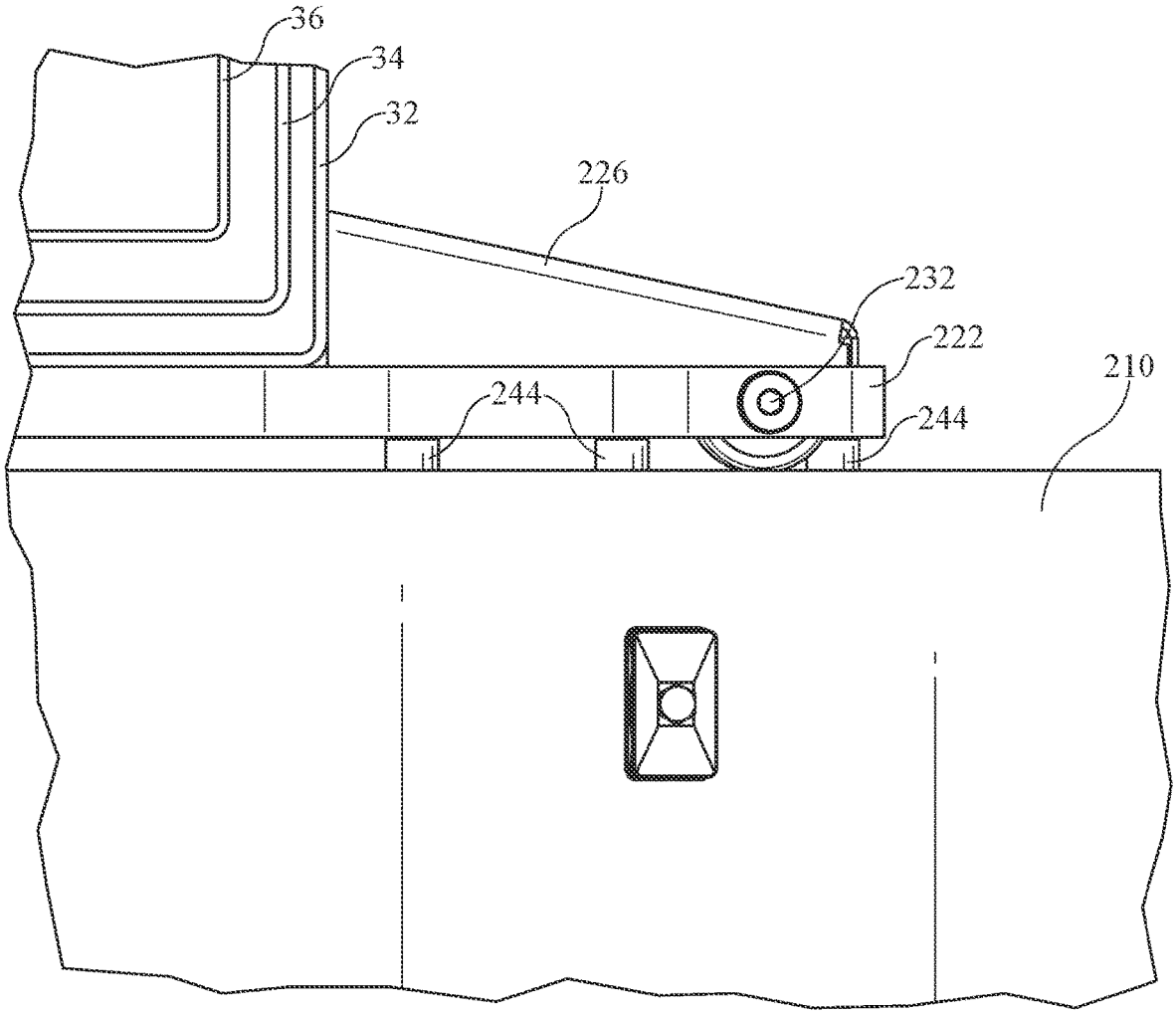
FIG. 15 is a partial perspective view of a swing boom assembly.

Referring now to FIGS. 9-11, and in accordance with some embodiments, a boom pivot assembly 130 may include a cylindrical pivot post 140 that has an enclosed bottom 142. Bottom 142 includes a plurality of apertures 144 therein through which a plurality of fasteners 146 can be positioned. Pivot post 140 may in some embodiments be manufactured of steel, and further is open along a top portion 148 thereof. Pivot post 140 top portion 148 is secured to exterior boom section 32 at the rear end 31 thereof, for example by welding or suitable known fasteners. Pivot post 140 bottom 142 extends through an aperture 54 in frame assembly 50 that is sized to accept pivot post 140.

Pivot assembly 130 further includes a keeper plate 160 having a plurality of apertures 162 therein, that align with apertures 144 of pivot post bottom 142. Keeper plate 160 is in some embodiments sized larger than the outside diameter of pivot post 140, such that a plurality of fasteners 146 may be inserted and secured through keeper plate 160 and pivot post 140 bottom 142, thereby rotatably securing pivot post 140 to frame assembly 50.

Pivot assembly 130 may also, in some aspects, include a cylindrical pivot bushing 170 that encloses pivot post 140 and is sized to be positioned between exterior boom section 32 and frame 50, thereby providing support and friction reduction for pivot post and boom assembly 30. In exemplary embodiments pivot bushing 170 is constructed of a low-friction, abrasion resistant, and moisture and chemical resistant material. In some embodiments pivot bushing may be constructed of ultra-high molecular weight polyethylene material (UMHW) or poly tetra-fluoroethylene material (PTFE). UHMW pivot bushings 170 may be advantageously used in some embodiments since UHMW material is highly resistant to abrasion, industrial chemicals, and wear.

Figure 3:
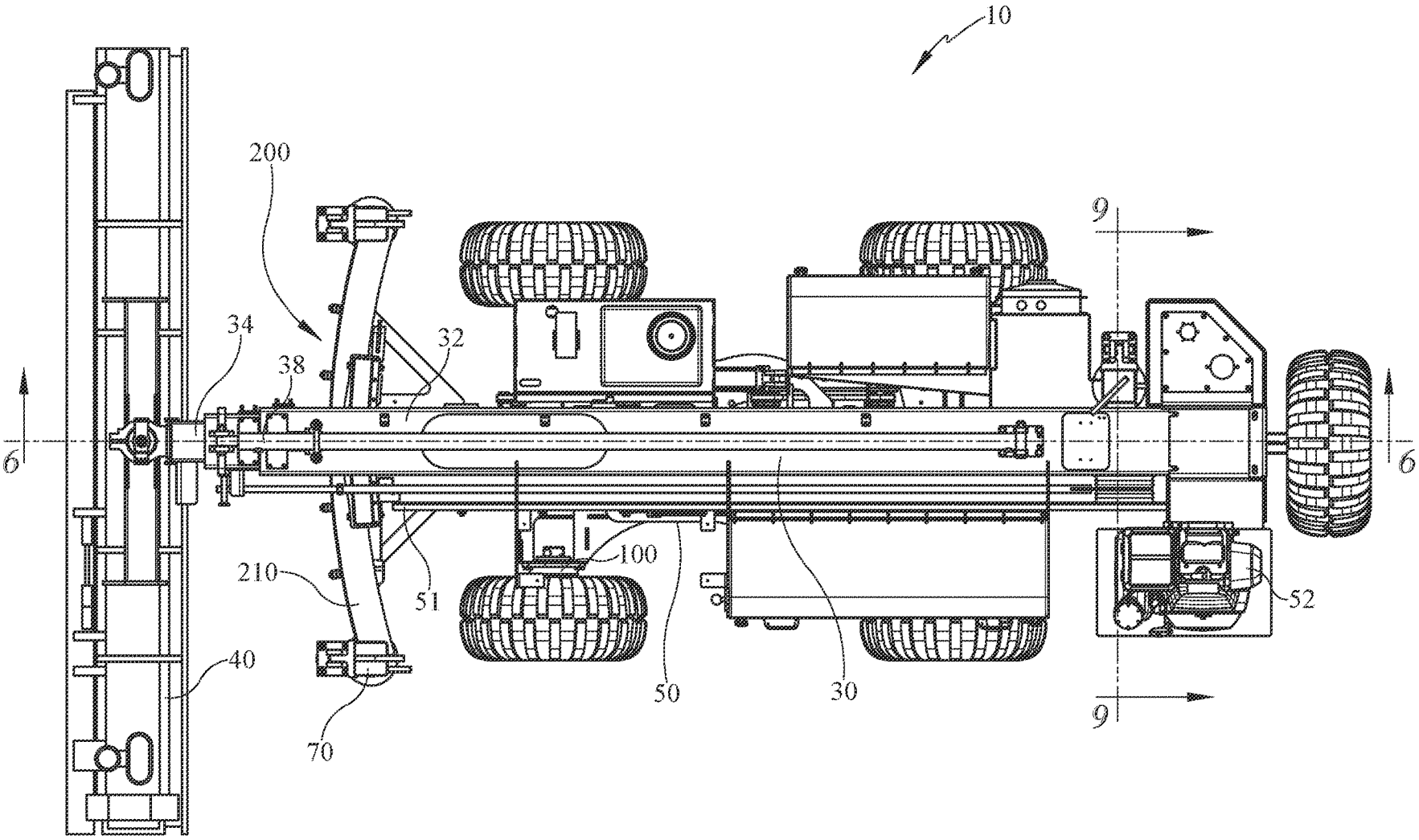
FIG. 3 is a top view of a concrete screeding apparatus in accordance with one embodiment.
Figure 4:
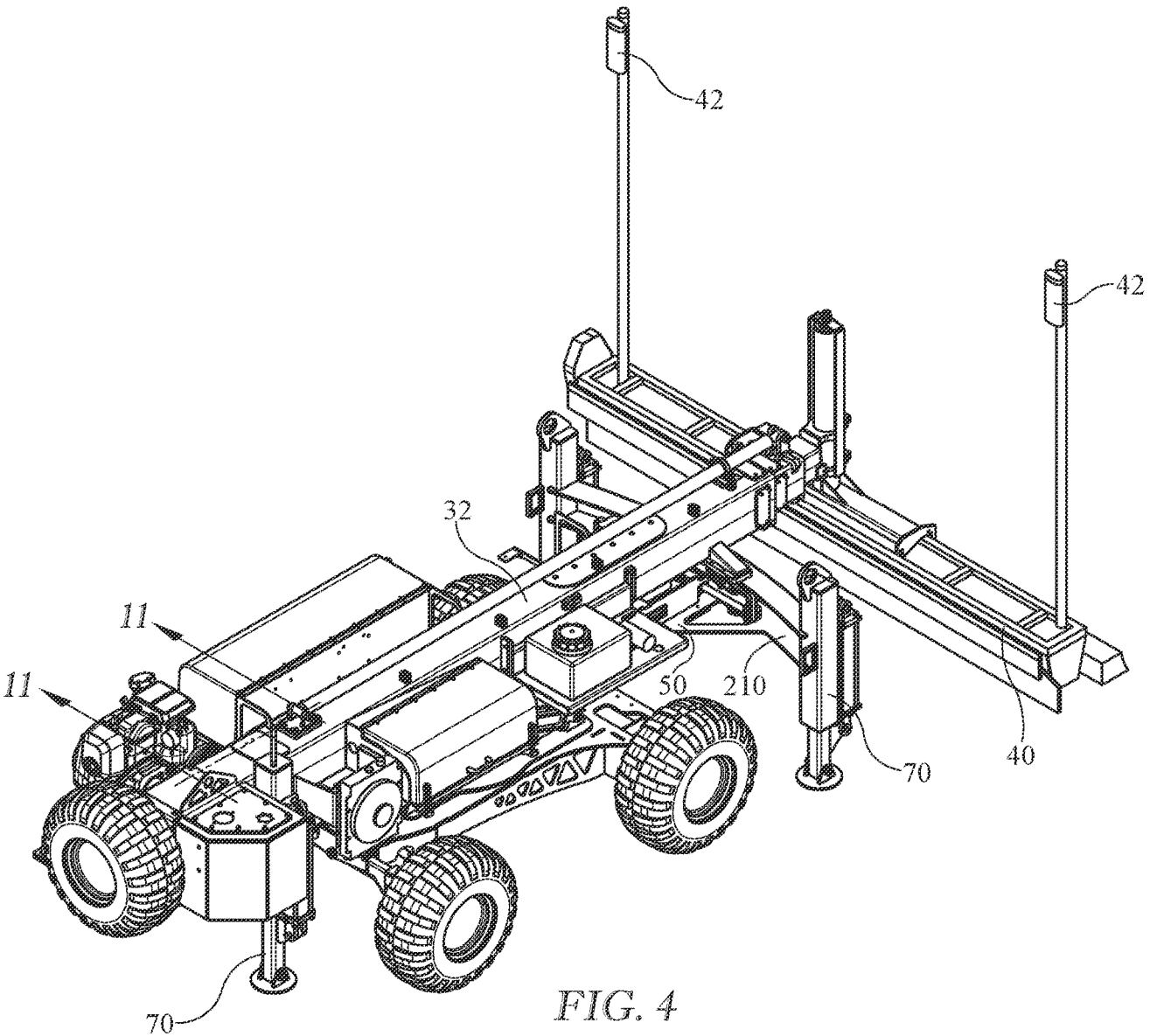
FIG. 4 is a perspective view of a concrete screeding apparatus in accordance with one embodiment.
Figure 5:
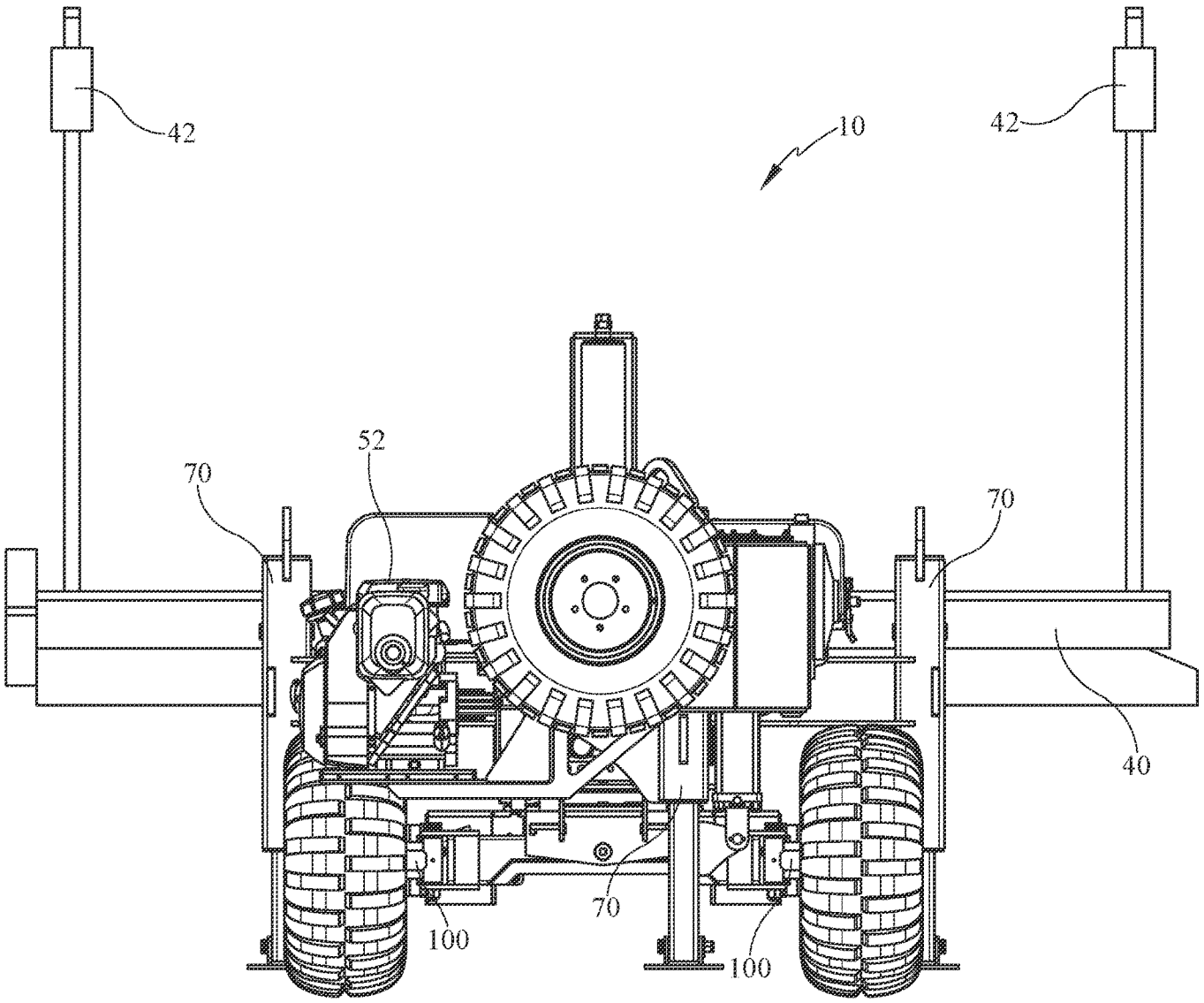
FIG. 5 is a rear view of a concrete screeding apparatus in accordance with one embodiment.
Figure 6:
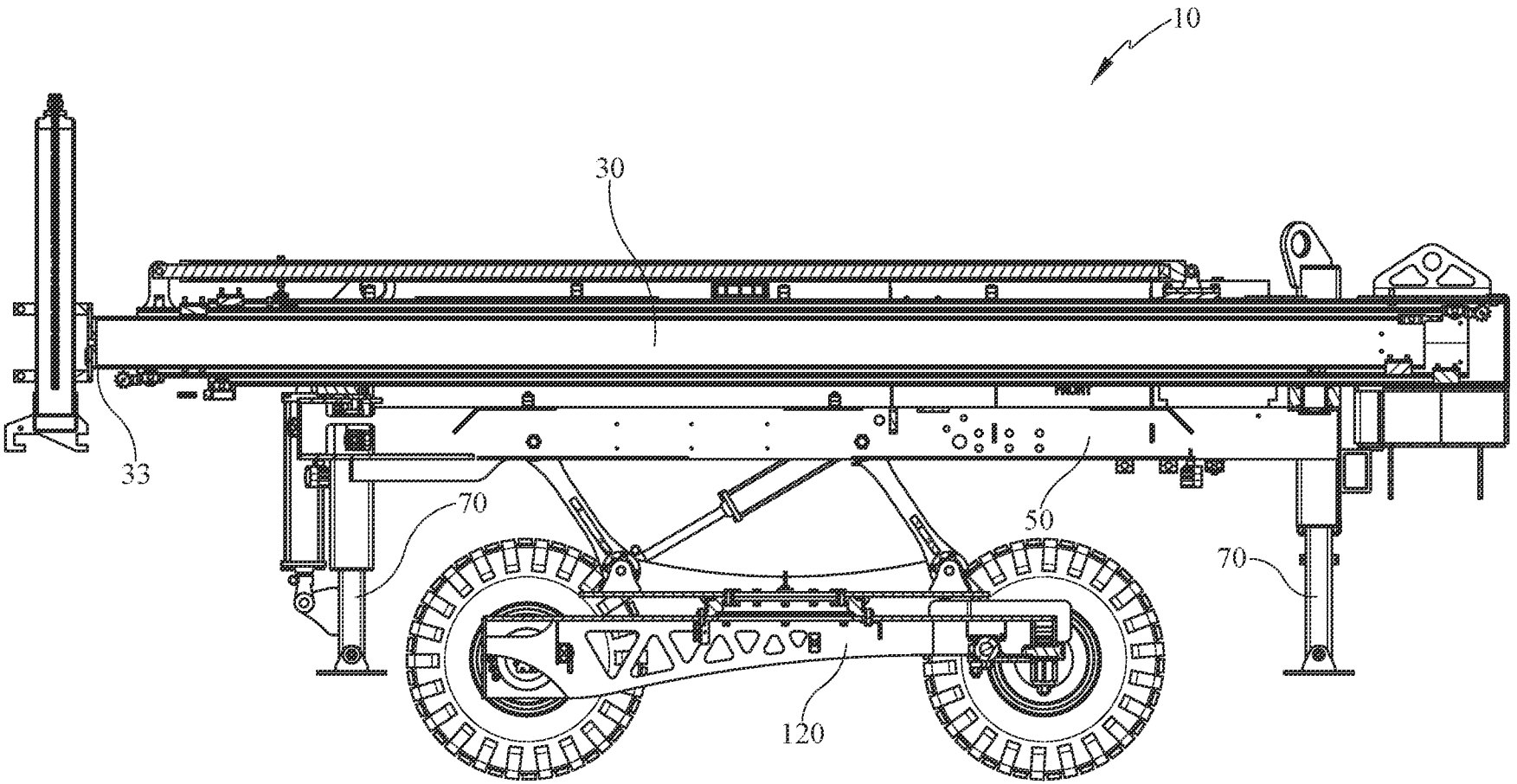
FIG. 6 is a cross-sectional view of a concrete screeding apparatus taken along the line 6-6 of FIG. 3 in accordance with one embodiment.
Figure 7:
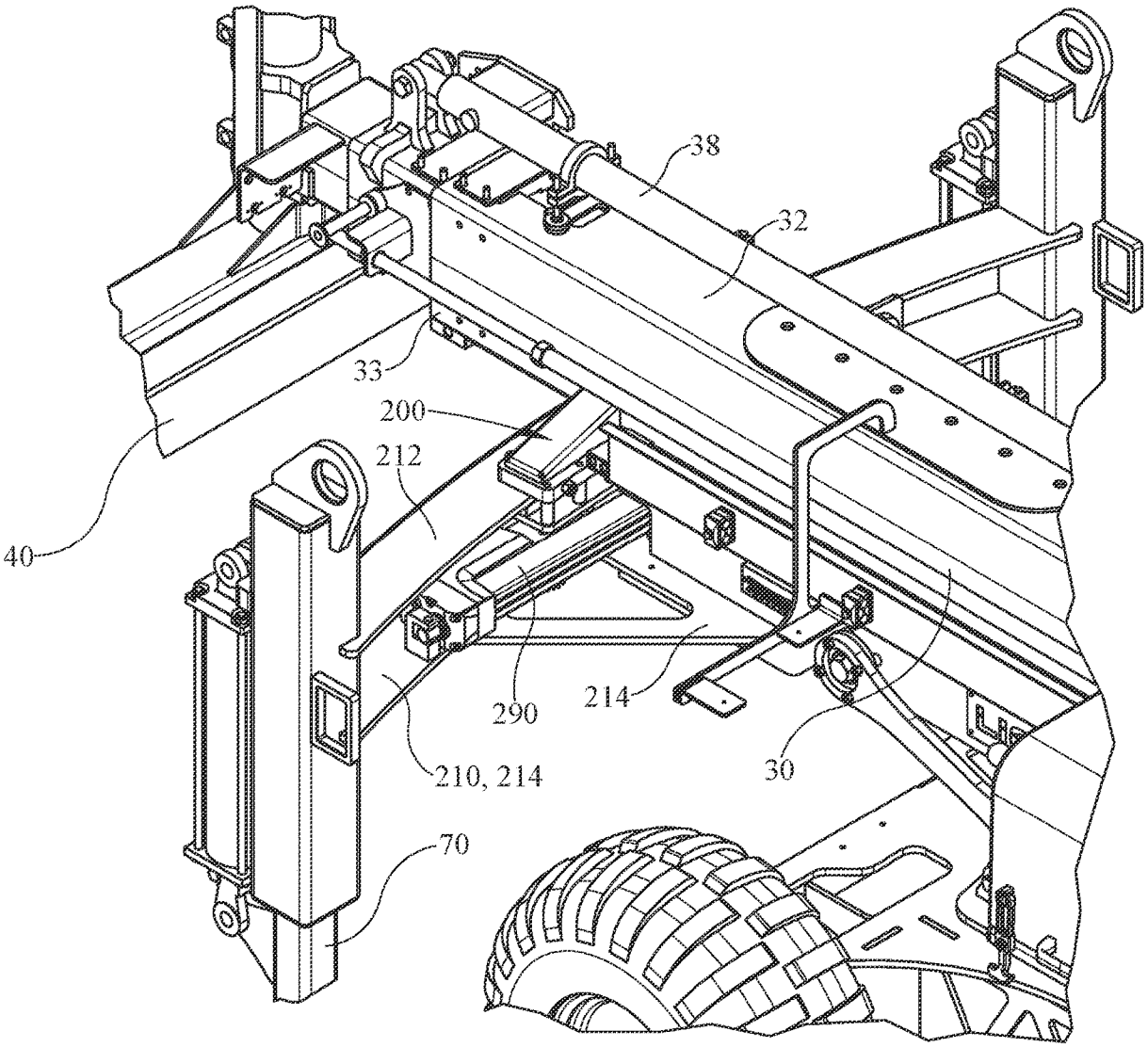
FIG. 7 is a partial detail view of a concrete screeding apparatus in accordance with one embodiment.
Figure 8:
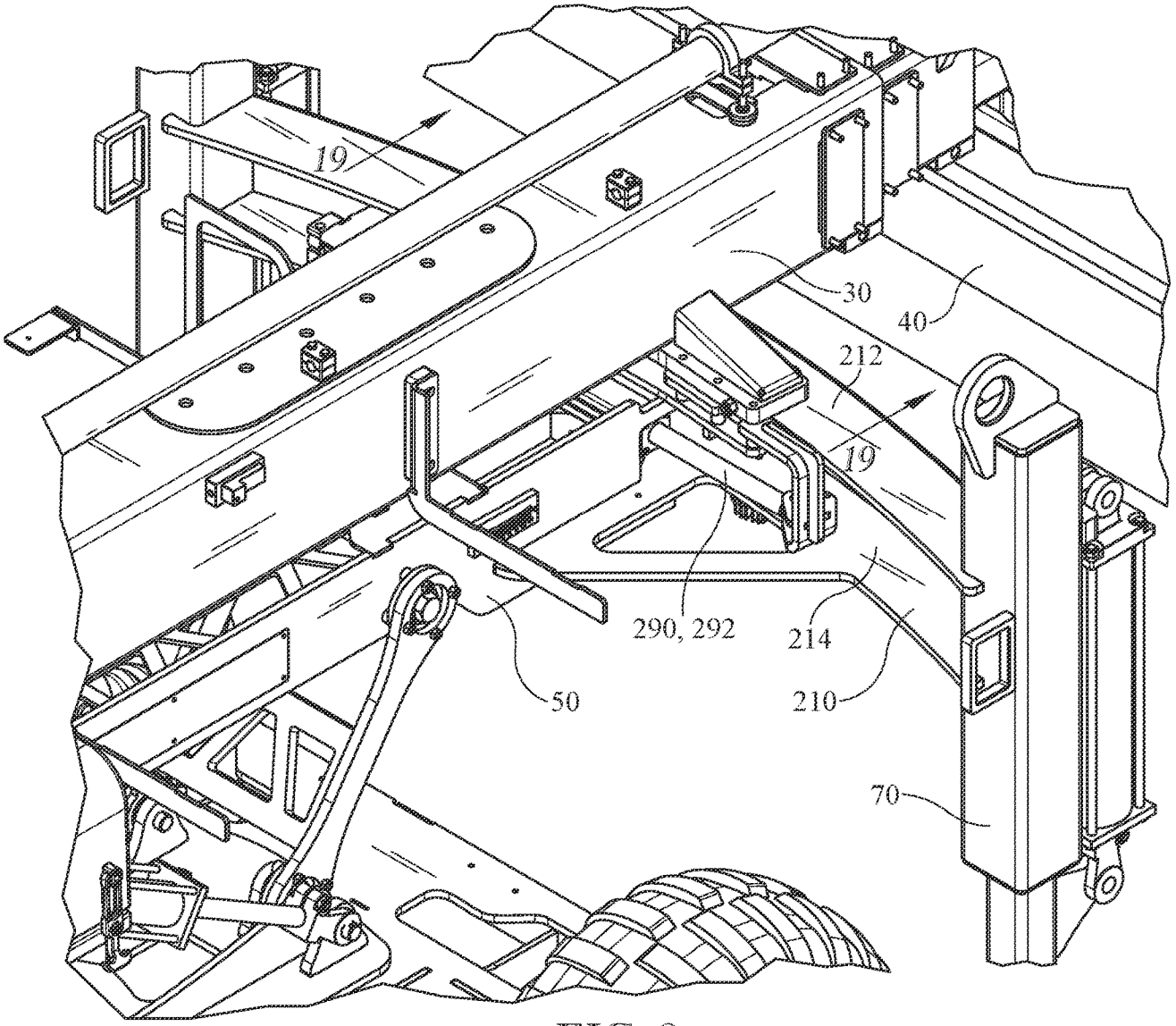
FIG. 8 is a partial detail view of a concrete screeding apparatus in accordance with one embodiment.

Referring now to FIGS. 12-20, and in accordance with some embodiments swing boom system 200 may include a generally horizontally oriented front member 210 to which opposed pair of leveling legs 70 are secured at either end thereof. As best seen in FIGS. 3 and 4, leveling legs 70 may be secured to front member 210 at either end thereof such that front member 210 is raised or lowered with the operation of leveling legs 70. Boom assembly 30 is then adjustably secured to front member 210. Thus in the embodiments depicted in the drawing Figures the three leveling legs 70 function to level the entire apparatus, including frame 50, boom 30 and screed head 40, which is secured to a terminal end of boom 30.

As best depicted in FIGS. 7, 8, and 12-19 and in accordance with some non-limiting embodiments front member 210 includes a top portion or flange 212 that is generally oriented horizontally, a bottom portion 214 that is also generally horizontally oriented, and a front portion 216 that is generally vertically oriented and connects top 212 and bottom 214 portions. Frame 50 is rigidly secured to front member 210 at a point, or a plurality thereof, such that front member 210 moves vertically with frame 50 as leveling legs operate. Furthermore, and in accordance with some aspects and embodiments, front member 210 generally describes an arc along its length as best seen in FIGS. 1 and 3, for example.

In the disclosed embodiments boom 30 exterior section 32 is adjustably or slidably mounted to move laterally or generally horizontally across an upper surface 213 of top portion 212 of front member 210 relative to frame 50. Since front member 210 is slightly arcuate in shape, as boom 30 pivots around axis 31 and slides laterally across front member 210 screed head 40 moves in a slight arc. By enabling boom 30 to move laterally across front member 210, when all boom sections 34, 36 are extended outwardly, screed head 40 has the ability to move side to side (laterally) and thereby screed around obstacles in a concrete pour, for example building columns or pipe chases. In some embodiments, front member 210 may be a relatively straight member 210 without departing from the scope of the disclosed embodiments.

As best depicted in FIGS. 12-19 and in accordance with various embodiments swing boom system 200 includes an opposed pair of roller assemblies 220, one located on each side exterior boom 32. Roller assemblies includes a boom mounting plate 222 that is generally flat and secured to exterior boom 32. Boom mounting plate may be, in some embodiments, constructed of steel or an equivalent high strength material. At one end of each boom mounting plate 222 an aperture or slot 224 is provided through plate 222 to accommodate a roller element 230, for example a roller bearing, ball bearing, radial ball bearing, wheel, or other equivalent mechanism that is mounted transversely to boom 32, such that roller element 230 contacts and rolls across top surface 212 of front member 210. For purposes of this specification the term "roller bearing 230" will be utilized throughout for clarity and ease of explication.

Figure 16:
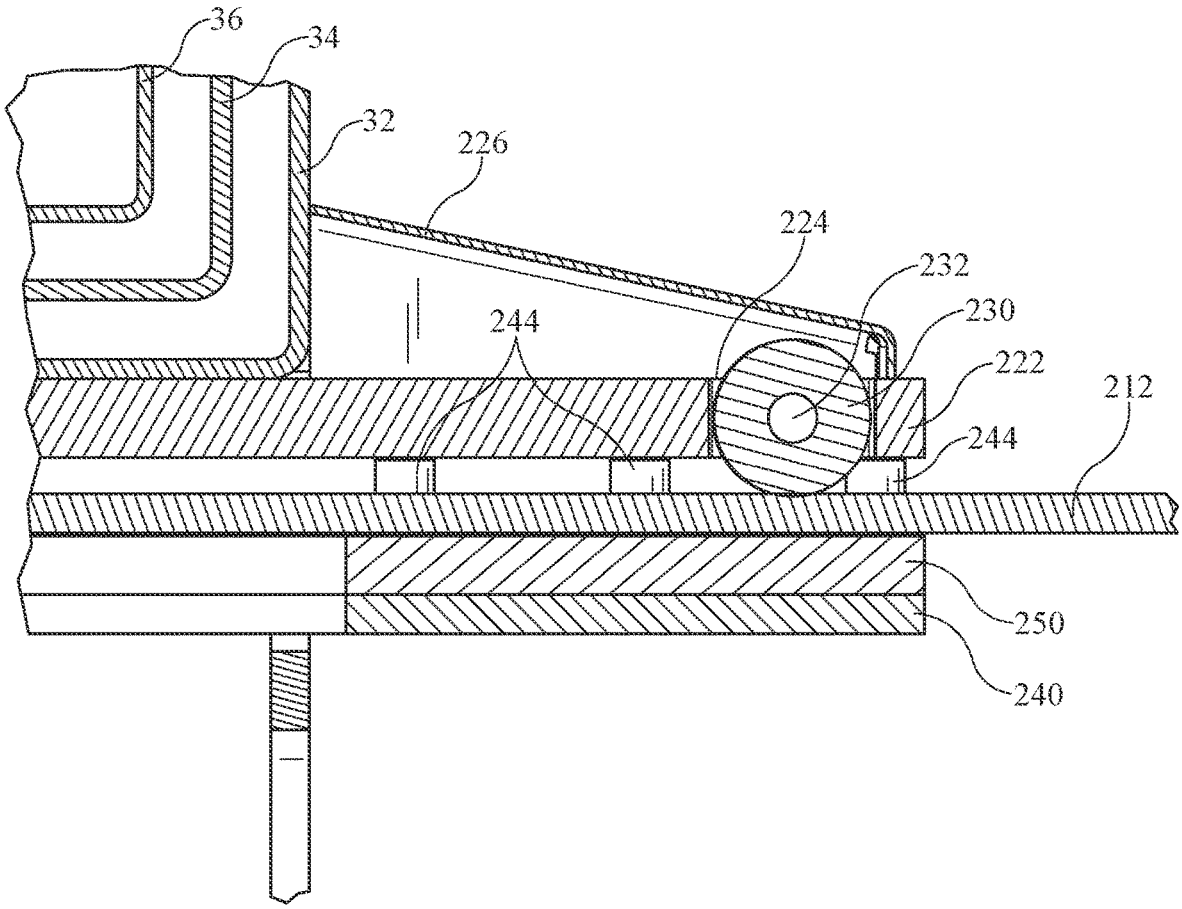
FIG. 16 is a partial cross-sectional view of a swing boom assembly taken along the line 16-16 of FIG. 13.
Figure 17:
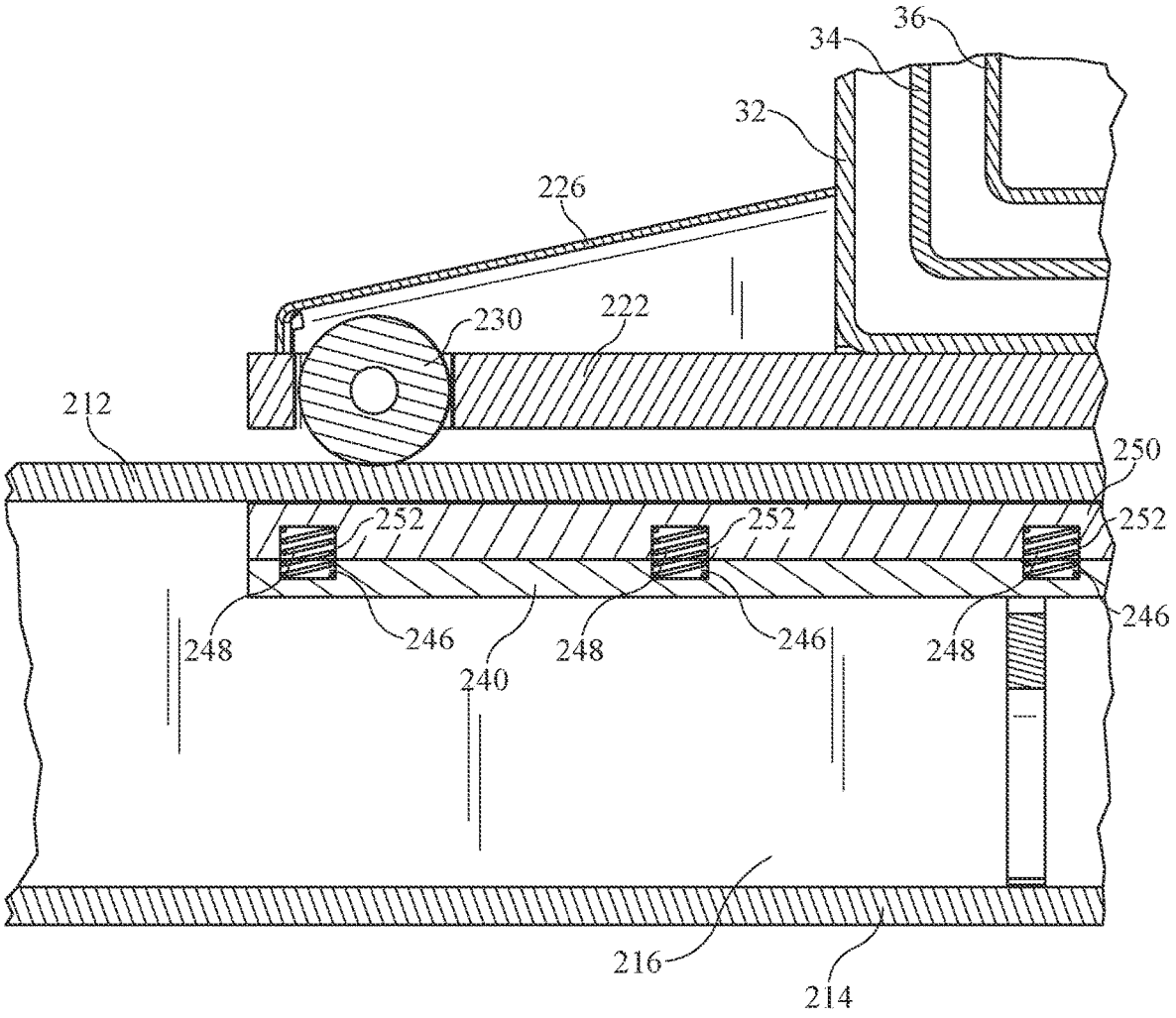
FIG. 17 is partial cross-sectional view of a swing boom assembly taken along the line 17-17 of FIG. 13.
Figure 18:
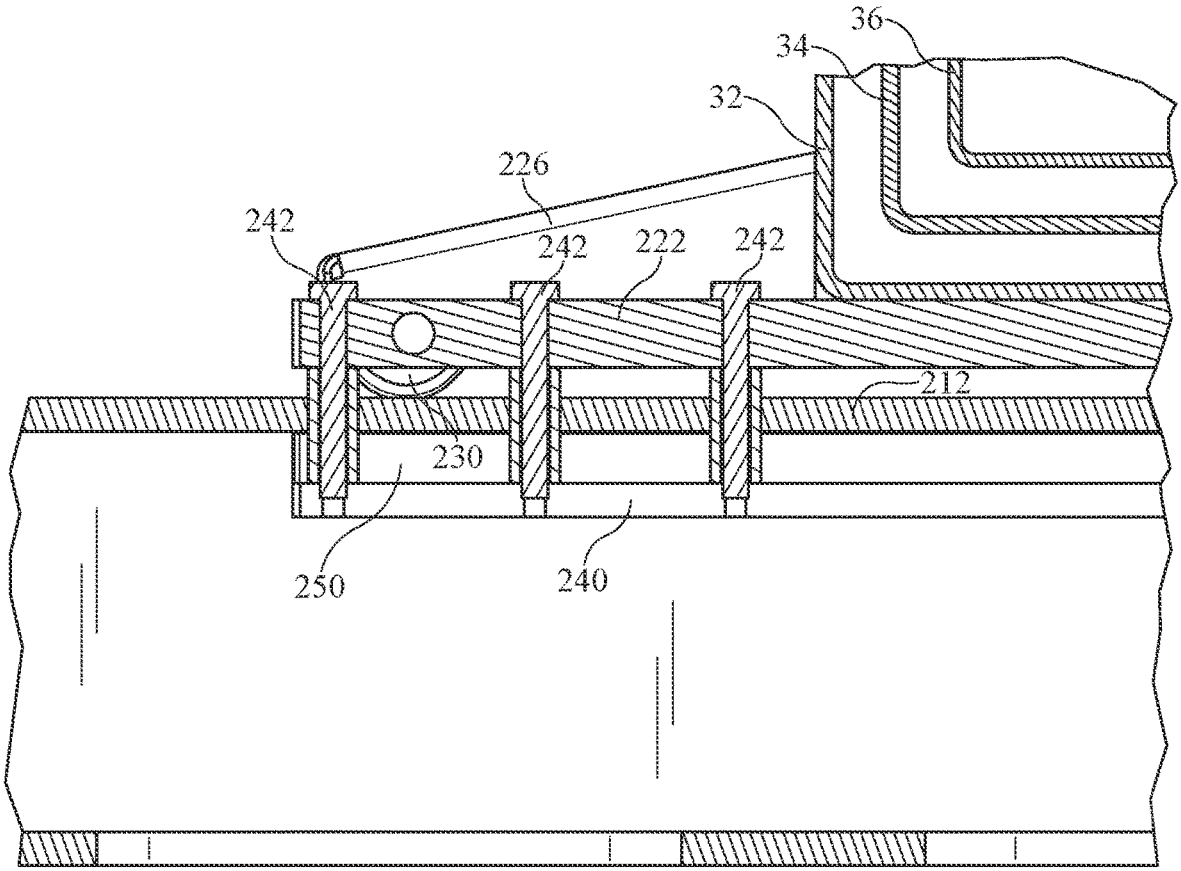
FIG. 18 is partial cross-sectional view of a swing boom assembly taken along the line 18-18 of FIG. 13.
Figure 19:
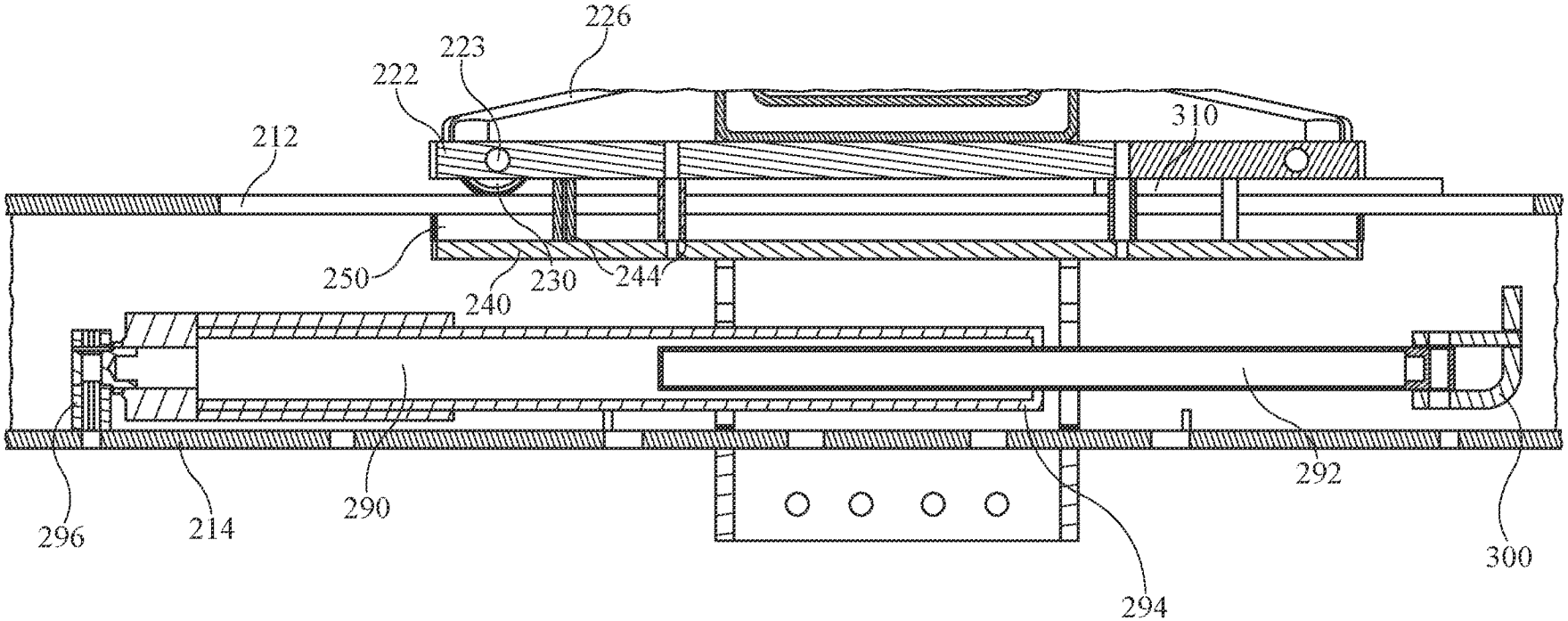
FIG. 19 is a cross-sectional view of a swing boom assembly taken along the line 19-19 of FIG. 8.

As seen in FIG. 16 roller bearing 230 may extend completely through boom mounting plate 222. A shroud or cover 226 on each side of exterior boom 32 may be secured to boom mounting plate 222 to cover and protect roller bearing 230 from environmental contaminants, dust, concrete and the like. In some embodiments roller bearing 230 may be mounted on an axle 232 that is secured to boom mounting plate 222. While the depicted exemplary embodiments show two roller bearings 230, one on each side of boom 32, a plurality of roller elements 230 may be secured for rotation at various points in plate 222 to thereby provide reduced-friction lateral movement of boom assembly 30 across front member 210. It should be understood from the disclosed embodiments that a variety of bearings may be employed in the construction of roller assembly 220 without departing from the scope of these embodiments.

In accordance with some aspects and embodiments swing boom system 200 further includes a backing plate 240, typically constructed of steel or an equivalent high strength material. Backing plate 240 is positioned below boom mounting plate 222 on the underside of portion 212 of front member 210, and is secured in spaced relation to mounting plate 222 by a plurality of fasteners 242 and concomitant stand-offs 244. Furthermore, backing plate 240 may include a plurality of recesses 246 therein, to accept and secure a plurality of compression springs 248, as detailed herein below.

Swing boom system 200 further includes a wear pad 250 secured to backing plate 240, that is positioned between backing plate 240 and the underside of top portion 212 of front member 210. Wear pad 250 may, in some embodiments, be constructed of a moisture and chemical resistant, abrasion resistant, and low friction material. In some embodiments wear pad 250 may be constructed of ultra-high molecular weight polyethylene material (UMHW) or poly tetra-fluoroethylene material (PTFE). UHMW wear pads 250 may be advantageously used in some embodiments since UHMW material is highly resistant to abrasion, many industrial chemicals and wear caused by repeated use.

Wear pad 250 may also include a plurality of recesses 252 therein, mirroring and aligning with complementary backing plate 240 recesses 246, to engage and contain compression springs 248 when backing plate 240 and wear pad 250 are properly positioned. Thus compression springs 248 are captured between backing plate 240 and wear pad 250 and facilitate consistent contact between wear pad 250 and the underside of top portion 212 by forcing wear pad 250 into contact with the underside of top portion 212 as boom assembly 30 moves laterally. Wear pad 250 may also be replaced periodically, as required, to enable consistent and smooth lateral movement of boom assembly 30.

Figure 20:
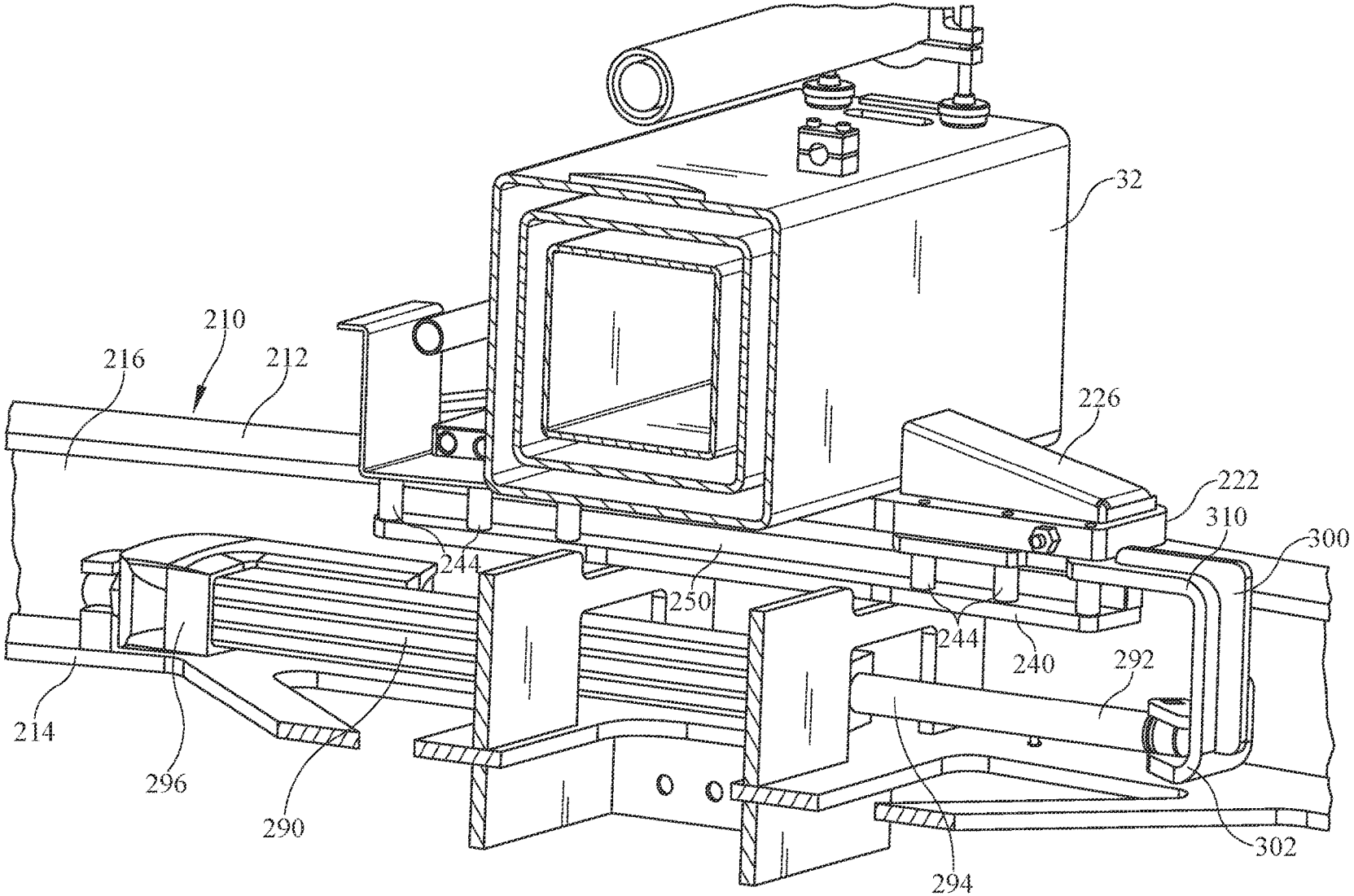
FIG. 20 is a partial perspective view of a swing boom assembly.

As best seen in FIGS. 20 and 21, and in accordance with some embodiments, boom 30, and thus screed head 40 may be moved laterally across front member 210 by operation of an actuator 290 that is secured to front member 210 at a point, and to swing boom assembly 200. Actuator 290 includes an extendable and retractable arm or link 292 at a first end 294 thereof, and a second end 296 that is secured to bottom portion 214 of front section 210. In some aspects and embodiments actuator 290 may be a linear actuator, hydraulic actuator, or any known actuating mechanism capable of imparting lateral relative motion between front member 210 and boom 30.

Actuator 290 first end 292 is secured to boom 30 via an actuator bracket 300 that links swing boom assembly with actuator 290. Actuator bracket 300 includes a first end 302 secured to a first end 294 of actuator 290 via a conventional fastener. Actuator bracket 300 may further include an actuator mounting plate 310 that is positioned between boom mounting plate 222 and backing plate 240. Actuator mounting plate 310 may include a plurality of apertures to accommodate stand-offs 244. Alternatively, actuator mounting plate 310 may include a plurality of integral stand-offs 244 that form a part of actuator mounting plate 310, through which fasteners 242 are inserted to secure boom mounting plate 222 and actuator mounting plate 310 to backing plate 240.

In operation, actuator 290 may be extended, forcing arm 292 to extend outwardly from actuator 290 and thus, through the connection of actuator bracket 300, force swing boom assembly 200 to move laterally across front member 210. Alternatively, actuator 290 may be retracted to move swing boom assembly 200 in the opposite direction. Obviously, this operation moves screed head 40 that is mounted to boom assembly 30 side to side, thereby enabling an operator to avoid and screed around an obstacle in a concrete pour.

Additionally, actuator 290 may be operatively coupled to an operator interface operatively coupled to screed apparatus 10 to control the motion of boom 30 and screed head 40 through a combination of hydraulic and electric actuators. In some embodiments operator interface may be a touch screen, switch, joystick, or other operator-controlled input device, that may in turn be operatively coupled to a hydraulic valve, or an electrical output for controlling actuator 290. In this fashion when an obstacle such as a column is encountered during screeding, an operator can use the operator interface to move screed head 40 to one side or the other to avoid the obstacle without the necessity of moving the entire screed apparatus 10.

In accordance with various aspects and embodiments, in operation boom 30 and thus screed head 40 may be pivoted around pivot assembly 130 and pivot post 140, proximate rear leg 70 by operation of actuator 290 to move screed head 40 around an obstacle or fixed object in the screed path. This feature provides the capability to screed around an obstacle while maintaining an extremely even grade surface without having to move screed apparatus 10 by operation of drive assembly 100. This embodiment provides an enormous time and labor saving over the life of the screed apparatus 10 since hand screeding work by an operator is minimized for each concrete pour.

One of ordinary skill in the art will understand that although some exemplary embodiments of screeder 10 utilize a boom-type screed device, the various teachings and features of swing boom assembly 200 disclosed herein may be employed with a variety of different screed types without departing from the scope of the disclosed embodiments.

While a variety of inventive embodiments have been described and illustrated herein, those of ordinary skill in the art will understand that a variety of other methods, systems, and/or structures for performing the function and/or obtaining the results, and/or one or more of the advantages described herein are possible, and further understand that each of such variations and/or modifications is within the scope of the inventive embodiments described herein. Those skilled in the art will understand that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope While the present embodiments and aspects have been shown and described herein in what are considered to be the preferred embodiments thereof, illustrating the results and advantages over the prior art obtained through the various embodiments, the apparatus is not limited to those specific embodiments. Thus, the forms of apparatus shown and described herein are to be taken as illustrative only and other embodiments may be selected without departing from the scope of the disclosed embodiments, as set forth in the claims appended hereto.

I claim:

1. An apparatus for screeding concrete to produce a level finished surface comprising:

a frame assembly having a front end and rear ends, said frame assembly having a pair of spaced vertically oriented stabilization legs secured to the front end thereof, said spaced legs supporting a generally horizontal front member therebetween, and at least one stabilization leg secured to the rear end thereof;

an extendable boom assembly having front and rear ends, and an exterior boom section pivotably secured to said frame assembly proximate said rear end thereof and to a screed head at said front end, said extendable boom assembly adjustably mounted on said front member; and a swing boom assembly having an actuator with an extendable arm thereon, said actuator secured at a point to said front member, and said extendable arm secured to said swing boom assembly to impart generally lateral motion thereto.

2. The apparatus of claim 1 wherein said actuator is a hydraulic actuator.

3. The apparatus of claim 1 wherein said actuator is a linear actuator.

4. The apparatus of claim 1 comprising:

an actuator bracket secured to said actuator arm and to said swing boom assembly to impart lateral motion thereto.

5. The apparatus of claim 1 wherein said front member comprises a generally horizontal arcuate portion along a length thereof.

6. The apparatus of claim 5 wherein said swing boom assembly comprises:

a boom mounting plate secured to said exterior boom section and disposed between said exterior boom section and said front member; and a plurality of roller bearings mounted for rotation to said boom mounting plate wherein said roller bearings contact said front member, thereby permitting said boom to move laterally.

7. The apparatus of claim 6 comprising:

a backing plate disposed below boom said mounting plate and secured in spaced relation thereto; and a wear pad secured to said backing plate between said backing plate and an underside of said horizontal member, whereby said backing plate contacts said horizontal member.

8. The apparatus of claim 7 comprising:

a plurality of compression springs disposed between said backing plate and said wear pad to provide generally upward spring force to said wear pad.

9. The apparatus of claim 6 comprising:

an actuator bracket secured to said actuator arm at a first end and to said boom mounting plate at a second end to impart lateral motion to said swing boom assembly.

10. The apparatus of claim 1 comprising:

a pivot assembly including a generally cylindrical pivot post having a bottom and an open top, said bottom extending through an aperture in said frame, and said top secured to said exterior boom section at a rear end thereof;

a keeper plate positioned below said frame aperture and secured to said pivot post bottom for rotatably securing said pivot post to said frame.

11. The apparatus of claim 10 comprising:

a cylindrical pivot bushing sized to enclose said pivot post and positioned between said exterior boom section and said frame.

12. The apparatus of claim 11 wherein said pivot bushing is comprised of ultra-high weight molecular polyethylene.

13. An apparatus for screeding concrete to produce a level finished surface comprising:

a frame assembly having a front end and rear end, said frame assembly having a pair of spaced vertically oriented stabilization legs secured to the front end thereof, said spaced legs supporting a generally horizontal arcuate front member therebetween, and at least one stabilization leg secured to the rear end thereof;

an extendable boom assembly having front and rear ends, and an exterior boom section pivotably secured to said frame assembly proximate said rear end thereof and to a screed head at said front end;

a boom mounting plate secured to said exterior boom section and disposed between said exterior boom section and said front member;

a plurality of roller elements mounted for rotation to said boom mounting plate wherein said roller elements contact said front member, thereby permitting said boom to move laterally;

a backing plate disposed below boom said mounting plate and secured in spaced relation thereto;

a wear pad secured to said backing plate between said backing plate and an underside of said horizontal member, whereby said backing plate contacts said horizontal member; and an actuator with an extendable arm thereon, said actuator secured at a point to said front member; and said extendable arm secured to boom mounting plate to impart generally lateral motion to said boom.

14. The apparatus of claim 13 wherein said wear pad is comprised of ultra-high molecular weight polyethylene.

15. The apparatus of claim 13 comprising:

a plurality of compression springs disposed between said backing plate and said wear pad to provide generally upward spring force to said wear pad.

16. The apparatus of claim 13 comprising:

an actuator bracket secured to said actuator arm and to said boom mounting plate to impart lateral motion thereto.

17. An apparatus for screeding concrete to produce a level finished surface comprising:

a frame assembly having a front end and rear ends, said frame assembly having a pair of spaced vertically oriented stabilization legs secured to the front end thereof, said spaced legs supporting a generally horizontal front member therebetween, and at least one stabilization leg secured to the rear end thereof;

an extendable boom assembly having front and rear ends, and an exterior boom section pivotably secured to said frame assembly proximate said rear end thereof and to a screed head at said front end, said extendable boom assembly adjustably mounted on said front member;

a pivot assembly including a generally cylindrical pivot post having a bottom and an open top, said bottom extending through an aperture in said frame, and said top secured to said exterior boom section at a rear end thereof; and a keeper plate positioned below said frame aperture and secured to said pivot post bottom for rotatably securing said pivot post to said frame.

18. The apparatus of claim 17 comprising:

a cylindrical pivot bushing sized to enclose said pivot post and positioned between said exterior boom section and said frame.

19. The apparatus of claim 18 wherein said pivot bushing is comprised of ultra-high weight molecular polyethylene.

* * * * *